United States Patent [19]

Badillo

[11] Patent Number: 4,966,088

[45] Date of Patent: Oct. 30, 1990

[54] COMPOSITE ROTARY LOOP TAKER FOR LOCK-STITCH SEWING MACHINE

[75] Inventor: Paul Badillo, Denver, Colo.

[73] Assignee: Bakron Corp., Morton Grove, Ill.

[21] Appl. No.: 292,652

[22] Filed: Dec. 28, 1988

Related U.S. Application Data

[63] Continuation of Ser. No. 25,452, Mar. 13, 1987, abandoned.

[51] Int. Cl.[5] ..... D05B 57/08

[52] U.S. Cl. ..... 112/184; 112/230

[58] Field of Search ..... 112/184, 228, 230, 231

[56] References Cited

U.S. PATENT DOCUMENTS

| | | | |
|---|---|---|---|
| 1,299,468 | 4/1919 | Hohmann | 112/228 |
| 1,596,487 | 8/1926 | Hohmann et al. | 112/228 |
| 1,758,715 | 5/1930 | Parkes | 112/228 |
| 2,857,869 | 10/1958 | Odermann | 112/228 |
| 3,140,681 | 7/1964 | Corey | 112/228 |
| 3,223,060 | 12/1965 | Corey | 112/228 |
| 4,393,798 | 7/1983 | Cheng | 112/231 |
| 4,475,475 | 10/1984 | Zylbert | 112/228 |
| 4,493,278 | 1/1985 | Badillo | 112/184 |
| 4,601,250 | 7/1986 | Clement | 112/184 |
| 4,660,487 | 4/1987 | Mikuni | 112/230 |

FOREIGN PATENT DOCUMENTS

| | | | |
|---|---|---|---|
| 933601 | 9/1955 | Fed. Rep. of Germany | 112/230 |
| 1213898 | 11/1959 | France | 112/231 |
| 60-261490 | 12/1985 | Japan | 112/228 |
| 88625 | 11/1956 | Norway | 112/231 |
| 872822 | 7/1961 | United Kingdom | 112/231 |

*Primary Examiner*—Wm. Carter Reynolds
*Attorney, Agent, or Firm*—Clement and Ryan

[57] ABSTRACT

A composite rotary loop taker which includes a loop seizing point mounted on a substantially annular frame, for use in a lock-stitch sewing machine. The loop seizing point forms a smoothly curved junction with the leading edge of a crosswise member between the opposite sides of a rotatably mounted substantially annular frame, said smoothly curved junction adapted to receive a thread loop and expand the loop over a stationary bobbin basket to form a lock stitch. Preferably, the loop seizing point, downwardly extending lug toward the smoothly curved junction and an inwardly extending foot therefrom are metal, together with a crosswise reinforcing member and a partially circumferential supporting wall on the opposite side of the annular frame. The remaining elements of the annular frame are plastic which may have dispersions of substantially oriented fibers, glass fibers or lubricating fibers, and the frame is restrained from radial expansion and creep by a metal retaining means consisting of a ring substantially around the outer wall of the annular frame.

34 Claims, 6 Drawing Sheets

FIG. 20
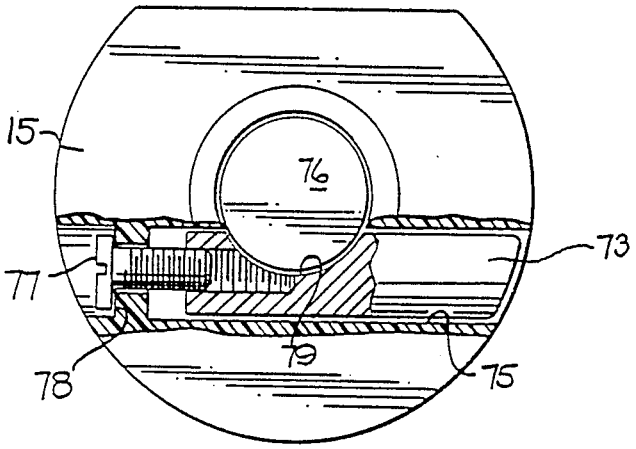
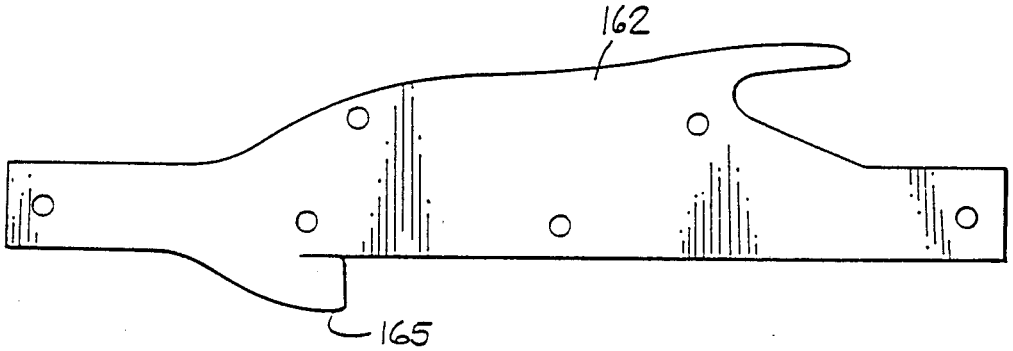
FIG. 21

COMPOSITE ROTARY LOOP TAKER FOR LOCK-STITCH SEWING MACHINE

This application is a continuation of application Ser. No. 07/025,452, filed Mar. 13, 1987 and now abandoned.

FIELD OF INVENTION

This invention relates to a rotary loop taker of composite material for use in a lock-stitch sewing machine in which the take-up device is located above the bobbin case, and in particular to such a loop taker that includes a hard metal hook or loop seizing point and a frame of plastic or other flowable, hardenable material.

BACKGROUND OF INVENTION

A rotary loop taker is a device that must be incorporated into all lock-stitch sewing machines. Perhaps 70 to 80 percent or more of all industrial sewing machines are of the lock-stitch type, and therefore utilize a rotary loop taker. Lock-stitch sewing machines of the type described are especially useful for sewing light-weight canvas or leather, or other light to medium-weight materials.

A conventional loop taker is cast or forged of fine steel and precision machined to exact proportions and balance throughout its extent from its weighted hub to its fine hook or "loop seizing point." It is a costly item, and a short-lived item under the heavy wear and tear that accompanies the use of a typical industrial sewing machine. Conventional loop takers normally have a life of only three to six months, depending on the many variables involved.

The loop taker and bobbin assembly operates under very demanding conditions. The loop taker typically rotates at 8,000 to 16,000 revolutions per minute around a stationary bobbin basket held by a bearing rib on its exterior circumference which rides in a circumferential raceway on the interior of the rotary loop taker frame. The bearing rib and the raceway are subjected to considerable vibration and impact and tend to become flawed, especially at their leading edges and initial portions. A flawed bearing rib or raceway quickly becomes seriously defective. The thread is then unable to pass freely around the bobbin case and often becomes jammed or broken, which necessitates replacement of the loop taker.

The most vulnerable part of the fragile loop seizing point of a rotary loop taker is the free end of the point. The tip can, for example, be chipped by the needle of the sewing machine or burred by the friction that is created by the high speed revolutions of the loop taker as it picks up the thread off the needle. Since a faulty hook or loop seizing point tends to skip stitches, fray or break thread, it must be repaired or replaced whenever its fragile loop seizing point accidentally breaks or becomes too dull through normal wear.

With a rotary loop taker of the usual type, most factories simply discard the entire device when the loop seizing point (which as pointed out above is conventionally an integrally formed part of the loop taker) becomes chipped or otherwise rendered unusable. Others send the rotary loop taker to a facility that reprocesses the tip of the loop seizing point. Either solution is very costly.

The common approach to reducing the expense of replacing or refurbishing worn-out loop takers has been to attempt the design of a detachable, replaceable loop seizing point. Under that approach, the loop seizing point is replaced, while the remainder of the loop taker is saved. Beginning at least as early as 1922, there has been a discussion in the industry of the need to reduce replacement costs by designing such a replaceable loop seizing point. See Dickson U.S. Pat. No. 1,431,380, issued Oct. 10, 1922. A number of other inventors followed the same approach, including Corral et. al. U.S. Pat. No. 2,002,172 issued May 21, 1935, Joseph U.S. Pat. No. 2,495,637 issued Jan. 24, 1950, Thierman German Pat. No. 933,601 issued Sept. 29, 1955, Grabowski U.S. Pat. No. 3,139,050 issued June 30, 1964, Corey U S. Pat. No. 3,140,681 issued July 14, 1964, Corey U.S. Pat. No. 3,223,060 issued Dec. 14, 1965 and Kuhar U.S. Pat. No. 3,465,700 issued Sept. 9, 1969. These devices had little commercial success, mainly because most of them described devices with laminations parallel to the axis of rotation of the rotary loop taker shaft, which created cracks and discontinuities where dirt or lint would collect, the thread would catch, or the assembly would be weakened.

The problem of expensive loop taker replacement was finally overcome with the detachable loop seizing point described in Badillo U.S. Pat. No. 4,493,278 issued Jan. 15, 1985, assigned to the assignee of the present invention. The Badillo patent successfully described a detachable loop seizing point that utilizes an inwardly extending lug foot to avoid the cracks and discontinuities pervasive in earlier attempts.

Conventional one-piece metal loop takers suffer from several other drawbacks aside from costs, and those drawbacks are generally shared by two-piece designs with detachable loop seizing points. For example, the loop takers require frequent oiling of the contact surfaces between the loop taker and the bobbin basket. The oil occasionally finds its way to the thread and is carried onto the cloth. A significant number of rejections result.

Another problem inherent in metal loop takers is galling of the metal surfaces in contact with one another. High speed operation of the loop taker creates heating and friction between the bobbin basket bearing rib and the frame raceway, which can ultimately cause the bearing surfaces to wear out, overheat or "freeze up." This is a particular problem in machines used for sewing fine cloth which are oiled sparingly to avoid oil stains.

Still another troublesome condition that results from the wearing of the bobbin case raceway in the conventional rotary loop taker is known in the industry as "slop." This condition is the excessive "play" between the bobbin basket and the inner wall of the loop taker which defines the bobbin case raceway. Slop may cause skipping of stitches because the needle may not enter the proper location through the bobbin basket in horizontal shaft machines to form a small loop to be picked up by the seizing point. Slop interferes with the proper release of the top thread (i.e., the needle thread) from around the bobbin case, and increases the incidence of jamming between the bobbin case and raceway. It also tends to cause large, undesirable loops of top thread to be formed on the bottom of the material being sewed, because of the premature closing of the escape exit for the top thread. It may also cause the top thread to break, if a bunching of thread occurs because of the degree of "slop" that is present. Finally, if serious jamming of the top thread occurs, the upper ledge of the bobbin case raceway on the loop seizing point may be broken as the operator or mechanic manipulates the bobbin basket in an attempt to free up the jammed thread.

Even loop takers made of expensive, high strength, precision machined steel have short lives under these demanding conditions. Thus, it is no surprise that the industry has assumed that effective loop takers of inexpensive, easily machined materials would not be possible. However, that is exactly the approach of the present invention. The inventions described above sought to reduce expenses by permitting replacement of only the loop seizing point while saving the rest of the loop taker. In contrast, this invention reduces expenses by altering the composition of the loop taker and thereby reducing its manufacturing costs. The reduced manufacturing costs are achieved by utilizing a composite of metal on high wear and high impact areas, embedded in a novel frame of plastic or other flowable material that is easily manufactured without expensive machining, forging or casting. Thus, the loop taker is still discarded after the loop seizing point wears out, but the replacement cost is dramatically lower. Not only is the present invention much less expensive to manufacture than existing loop takers, it is also surprisingly more effective. As described in detail below, the plastic surfaces are lightweight, self-lubricating and nearly friction-free.

A loop taker of two dissimilar materials is described in Haas U.S. Pat. No. 2,219,308 issued Oct. 29, 1940, but that loop taker is for a specialized application not relevant to this invention. The Haas invention is for a low speed wax thread sewing machine. As explained in that patent, loop takers of wax thread sewing machines must be kept at a constant temperature to keep the wax liquid without burning it. The invention utilizes certain resin components, but primarily for the purpose of promoting even heat distribution. Haas also recognized that a wax thread loop taker must have smooth continuous thread-bearing surfaces to avoid catching the thread or accumulating wax on the loop taker. However, the approach of Haas for achieving smooth surfaces was exactly the opposite of the approach of the present invention, and in fact teaches away from the present invention. Haas used resin components on the thread bearing surfaces with optional interior metal reinforcing members. On the other hand, the applicant of the present invention takes care to avoid any non-metal thread bearing surfaces, since these surfaces are subjected to high surface stress and impact. While Haas might have been feasible for low speed wax thread (although there is no evidence the invention was actually commercialized or successful), it would not have survived the conditions of high speed dry thread machines.

SUMMARY OF THE INVENTION

The rotary loop taker of this invention is adapted for rotation about a generally cylindrical bobbin case maintained in a fixed position in a lock-stitch sewing machine below the take-up device of the machine. The loop taker comprises a frame of substantially annular construction having an axis of rotation located generally perpendicular thereto, means for rotatably supporting the frame, and a loop seizing point integral with or embedded in the frame. As the annular frame supporting means rotates during operation of the sewing machine, the frame rotates about its axis of rotation (which is the axis of rotation of the rotary loop taker) and about the fixed bobbin basket in a predetermined plane, which plane may be horizontal, vertical or other so long as the take-up device is above the bobbin case. When the means for supporting the annular frame is a rotatable shaft, a vertically oriented shaft will rotate the frame in a horizontal plane, and a horizontally oriented shaft will rotate the frame in a vertical plane. Inexpensive loop takers of the type described herein are typically used in horizontal shaft machines as shown herein, but may also be used in vertical shaft machines.

The frame has a cut-away portion along one segment of its circumference to provide space for the needle thread to exit from the loop seizing point. The "cut away" portion is defined by an end wall of the substantially annular frame on one end and by the forward and bottom edges of the loop seizing point on the other end. The loop seizing point has generally the same curvature as the substantially annular frame and has a point (which is herein referred to as the "free end" or "tapered forward end" to distinguish it from the rest of the loop seizing point) at its leading edge to pick up the thread loop from the needle.

The annular portion of the frame is attached to the rotating means with a crosswise member extending from the bottom circumference of the annular portion immediately behind the cut-out portion to the bottom circumference on roughly the opposite side of the frame. A smoothly curved junction is formed by one edge of the crosswise member and the bottom of the loop seizing point, which junction receives the thread loop. At the center of the crosswise member is mounting means for the rotating means, which mounting means may be a hub or a shaft.

As in rotary loop takers of conventional construction, the raceway for accepting the radially extending rib of the bobbin case is defined by a "lower" ledge extending completely around the inner wall of the frame member and by a pair of "upper" ledges. (The ledges actually lie in a vertical plane in the horizontal shaft loop taker shown herein, but for convenience of identification, the ledge closest to the shaft is referred to as the "lower" ledge and the ledge farthest from the shaft is referred to as the "upper" ledge.) The first upper ledge is on the initial portion of the annular frame which tapers to the loop seizing point inner wall and it defines the upper part of an initial portion of the bobbin basket raceway. The second upper ledge is provided by a gib that is detachably secured to the frame, and it defines the middle and final portions of the raceway. Throughout the entire extent of each ledge, the bottom surface of the upper ledge lies in substantially one plane and the upper surface of the bottom ledge each lies in substantially one plane slightly beneath the upper plane. The raceway travels about the stationary bobbin basket on a bobbin bearing rib so that the bobbin basket is maintained above the crosswise member with a space therebetween for the thread loop to pass.

The loop seizer frame is made substantially from a flowable, hardenable material. Injection molded plastic is ideal for this purpose because large quantities may be molded quickly and inexpensively. Moreover, the finish on injection molded plastic can be of the requisite smoothness without any machining or other post injection processing. Also important is that the plastic may be a self-lubricating type such as Acetal Celcon® or Delrin® which are crystalline thermoplastic polymers with high melting points and dispersions of lubricating TFE fibers, available from Dupont. Such a self-lubricating plastic will both avoid rejections of sewn products caused by oil spreading onto the thread and carrying into the cloth, and will also prevent jamming or galling at the contact surfaces between the loop taker and the bobbin basket.

The exposed surfaces of the loop taker should be metal at areas of high stress or localized impact that are subject to chipping, breaking or wear. The metal is preferably steel with a durometer hardness of 58 to 62 although it is known that durometer hardness of 40 or even lower may be functional, and is polished on the exposed surfaces to avoid thread snags and dirt accumulation. The metal portions may be rough forgings or casting followed by precision machining, or may be investment castings which require polishing but less machining. The loop seizers are then hardened by suitable annealing processes. Under either method of fabrication, it is important to note that the exposed steel surfaces are minimized in this invention, which in turn minimizes the precision fabrication required.

The steel loop seizing point is integral with a steel downwardly extending supporting lug on its bottom edge forming a forward facing end wall of the annular frame cut-out portion. The inner bottom of the downwardly extending lug together with the bottom portions of the loop seizing point form a smoothly curved junction with an edge of the crosswise frame member. The steel lug extends through such smoothly curved junction with an integral steel lug foot forming a corner of the crosswise frame member adjacent the loop seizing point. The loop seizing point, the downwardly extending supporting lug and the lug foot, with the smoothly curved junction connecting the three, are thus a single piece with polished exposed surfaces for taking up the thread loop and enlarging it around the bobbin case. The smoothly curved junction between the loop seizing point, downwardly extending lug and lug foot is preferably also gradually curved. The steel members provide the necessary rigidity for the loop seizing point and the necessary strength to transfer forces on the loop seizing point caused by collisions with the needle or otherwise through the downwardly extending lug and lug foot and into the crosswise member.

The lug foot advantageously extends inward from the lug a distance at least equal to the diameter of the largest thread with which the sewing machine is used. Good results are obtained if the lug foot extends inward from the lug at least about 1/32", and it is preferred that this dimension be at least about 1/16". A minimum of 1/64" is required for most applications. This again helps to avoid snagging the thread loop that is taken up by the rotary loop taker. In addition to avoiding the snagging of the needle thread, the provision of a foot extending inwardly from the lower portion of the downwardly extending supporting lug of the loop seizing point helps to achieve a secure and firm attachment of the seizing point to the substantially annular frame and the crosswise member of the rotary loop taker.

The steel loop seizing point has a single continuously tapered, or reduced, smoothly shaped integrally formed forward end or tip that extends forwardly of the downwardly extending lug into the cut-away portion of the frame, with no other projection extending forward of said lug. The loop seizing point is integrally formed from its tip to the lug and, preferably, is integrally formed with the lug and other metal portions of the loop taker. Behind the lug, the loop seizing point extends rearwardly along the annular frame about as far rearwardly of the downwardly extending lug as the reduced forward portion extends forward of the lug. The over-all length of the loop seizing point from the tip of its forward end to the end of its rear portion is a minor portion, suitably about one-third and preferably about one-quarter, of the circumference of the annular frame.

The crosswise frame member includes an interior steel reinforcing and anchoring member integral with the steel foot and in some embodiments disclosed extending the length of the crosswise member to the opposite annular wall of the frame. The crosswise reinforcing and anchoring member may be rough finished, for it is completely embedded in the plastic encasement of the crosswise frame member. Because the steel foot has an exposed surface adjacent to the smoothly curved junction with the bottom of the loop seizing point and downwardly extending supporting lug, there is required a step- down from the exposed surface of the lug to the non-exposed surface of the reinforcing member. The step-down, of course, is filled with the plastic encasement material so that the surface is a smooth abutment between the steel foot and the plastic.

Another important aspect of this invention is the composition of the raceway between the upper and lower ledges substantially around the interior wall of the annular frame through which the bobbin bearing rib travels. The initial portion of the upper ledge is a steel shoulder integral with and forming the lower edge of the loop seizing point extending one-fourth to one-third of the distance around the annular frame circumference. The middle and final portions of the upper ledge may also be steel or may be plastic depending on whether the bobbin retaining gib which forms such ledge is steel or plastic. For the bottom ledge, the configuration and positioning of the loop seizing point, downwardly extending supporting lug and lug foot with the smoothly curved junction therebetween allow the use of steel at the leading edge of the initial portion, where the greatest impact and stress occur. The steel leading edge of the lower ledge begins in the forward tapered portion of the loop seizing point and the downwardly extending lug and extends rearward to the trailing edge of the lug. The remaining portion of the initial portion of the lower ledge, and the middle and final portions beneath the gib, is subjected to much less stress and may be made of plastic. The use of deformable plastic for most of the lower ledge allows thread to pass between the bobbin bearing rib and the raceway, as occasionally happens under high speed operation, without jamming.

One of the obstacles to designing an inexpensive plastic rotary loop taker has been expansion of the loop taker in the radial direction caused by centrifugal force at high rotational speeds. As it expands, the loop seizing point moves away from the rotational axis, causing destructive collisions between the point and the needle. Moreover, over a period of time the loop taker experiences radial "creep" wherein it fails to contract to its original diameter after the rotation is stopped. The preferred embodiment of this invention prevents radial expansion by enclosing the substantially annular frame in a substantially annular ring made of steel or other rigid material completely around the outer wall of the annular frame. Alternatively, a portion of the annular ring may be formed by a steel bobbin retaining gib and the remaining portion by a plate extending around the annular frame exterior wall and attached to each end of the gib.

Whether the ring is one piece or several pieces, it may be an extension of and integral with a camming plate used to raise the thread loop over the bobbin. The annular ring may be secured to the annular frame by coarse-threaded screws that extend through the thin portion of the ring and through the gib into the plastic portion of the annular frame. Although coarse screws into the plastic portion of the annular ring generally provide sufficient attachment means, additional attachment support can be achieved with the use of fine-threaded screws extending through the thin portion of the ring and the gib and into the steel downwardly extending lug on the loop seizing point side of the annular frame and the steel supporting wall embedded in the opposite side of the annular frame described in the next paragraph. The annular ring may also be secured to the annular frame by slidably mounting the ring over a plastic shoulder on the frame.

At the annular wall of the frame opposite the loop seizing point, the crosswise reinforcing and anchoring member may be attached to or integral with a partially circumferential supporting wall embedded in the annular frame. It has been found that an embedded supporting wall extending one-fourth to one-third around the frame circumference and centered about the reinforcing member lends some additional rigidity to the frame, helps to secure the reinforcing and anchoring member to the frame, helps prevent radial expansion of the frame caused by centrifugal force during rotation, and can be of the dimensions necessary to balance the loop taker about its axis of rotation to reduce wear on the shaft and bearing surfaces. The supporting wall need not have any exposed surfaces and, in fact, will normally be fully encased in plastic to avoid the necessity for close tolerances and careful machining and polishing of the supporting wall surfaces Many advantages are provided by the composite rotary loop taker of this invention. These advantages include:

The rotary loop taker is very inexpensive to manufacture because most of the volume and surface area is made of inexpensive material, and that material requires little or no machining or polishing, such as injection moldable plastic.

The loop taker includes polished steel at the surfaces subjected to high stress and impact including the loop seizing point, the smoothly curved junction that receives the thread loop, and the initial portion of the raceway. Thus, the life of these surfaces is comparable to the life of the same surfaces on conventional loop takers.

The plastic portion of the loop taker may be self-lubricating, thereby reducing galling of friction surfaces and eliminating the use of lubricants which may stain the material being sewed.

The plastic raceway supporting the bobbin bearing rib allows thread to pass through without jamming. This advantage eliminates a substantial source of loop taker failures and resulting sewing machine down time.

The user will have greater production time per dollar expended for this rotary loop taker as compared to the conventional loop takers that have been in use for many decades.

The rotary loop taker of this invention should have a period of use longer than with conventional rotary loop takers.

BRIEF DESCRIPTION OF THE DRAWINGS

The invention will now be described with reference to the attached drawings in which:

FIG. 20 is a bottom plan view of an alternative means for attaching the rotary loop taker hub to a rotating shaft; and FIG. 21 is a plan view of the camming plate used in the present invention prior to its semicircular forming, showing a tab for bending into an air cooling fin to channel air into the bobbin case raceway.

DETAILED DESCRIPTION OF SEVERAL EMBODIMENTS

General Construction

Figure 1:
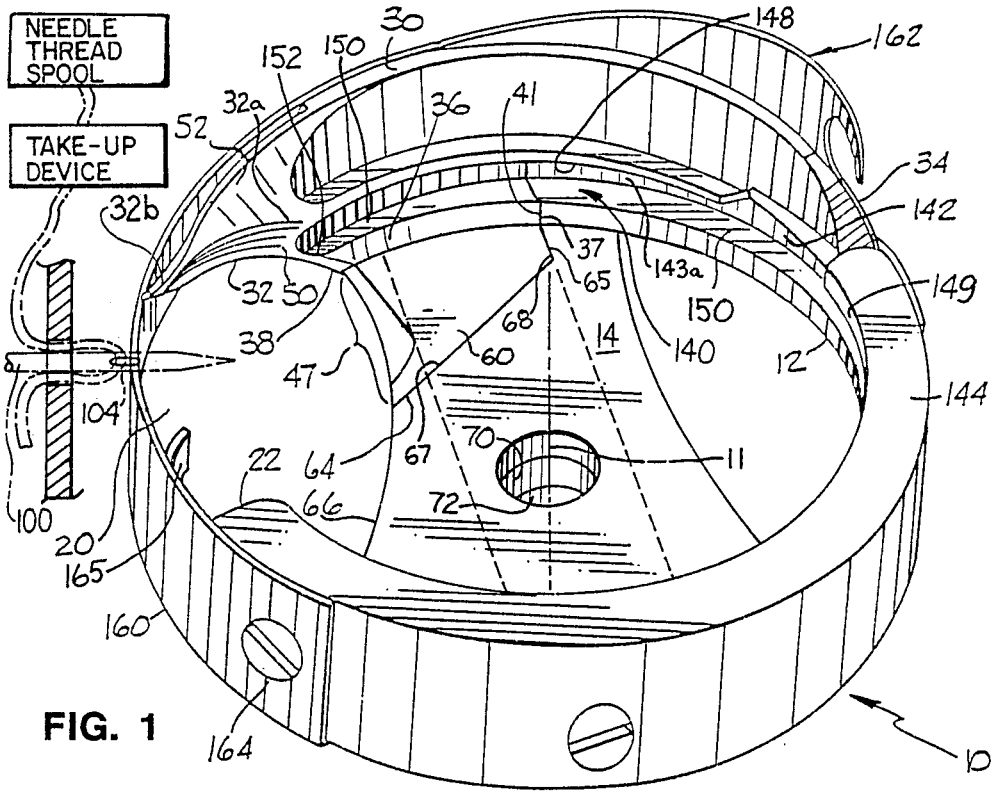
FIG. 1 is a three-quarters perspective view from the top of one embodiment of the rotary loop taker of this invention.

FIG. 1 is an enlarged, three-quarters perspective view of one embodiment of the rotary loop taker of this invention, indicated by the numeral 10. Rotary loop taker 10 is shown for clarity in FIG. 1 with its shaft vertically oriented, but in the position occupied by this particular embodiment of the loop taker of this invention when it is in its operative position installed in a lock-stitch sewing machine of conventional construction, the shaft of the loop taker is horizontally positioned. The take-up device (shown schematically in FIG. 1) of the horizontal shaft sewing machine in which loop taker 10 is thus installed is located above the bobbin basket. Bobbin basket 16 is shown in FIG. 8 in its operative position for use with loop taker 10 of FIG. 1, and in bottom plan view in FIG. 13.

Figure 4:
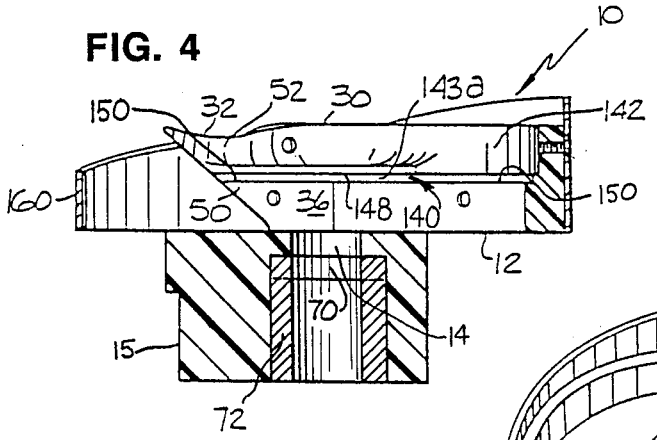
FIG. 4 is a cross-sectional view of the rotary loop taker of FIGS. 1 and 2, taken along line 4—4 of FIG. 2.
Figure 5:
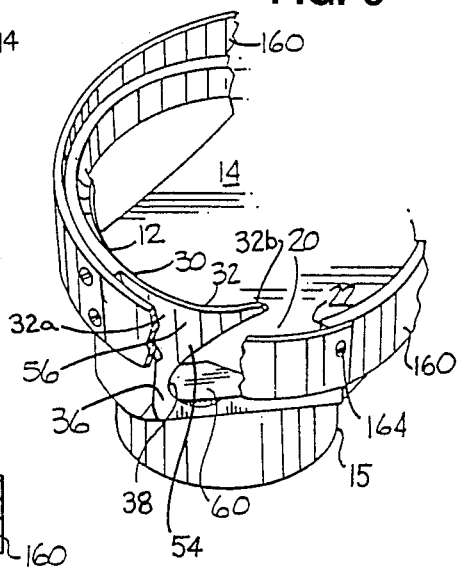
FIG. 5 is a reduced, fragmentary three-quarters perspective view from the top of the rotary loop taker shown in FIG. 1, taken generally from the left-hand side of FIG. 1, with a partial cut-away of the annular retaining ring.

Loop taker 10 includes a substantially annular frame 12, which is supported by a crosswise support member 14 extending from one side of the frame to the other. As shown in FIG. 5, which is a three-quarters perspective view of the loop taker 10 from the opposite side shown in FIG. 1, with a partial cut-away, and FIGS. 4 and 6, crosswise support member 14 is attached on its bottom side to a hub 15 which in turn is secured to a shaft (not shown) generally at right angles thereto. When this embodiment of rotary loop taker 10 is in use in a lock-stitch sewing machine, the shaft may be oriented in either a vertical or horizontal position or any other position. This arrangement of parts provides means for rotatably supporting the annular frame 12 in the lock-stitch sewing machine. The shaft is in turn connected to the actuating mechanism of the sewing machine, and during use of the machine is rotated to cause frame 12 to rotate in a predetermined plane about its axis of rotation 11, and about the associated bobbin basket. (Axis 11, which is generally perpendicular to the predeterminted plane just mentioned, is the same as the axis of rotation of the rotary loop taker.) Although the present invention is most often used in horizontal shaft machines, it may also be used effectively in vertical shaft machines with no change in the relative position of elements.

Figure 8:
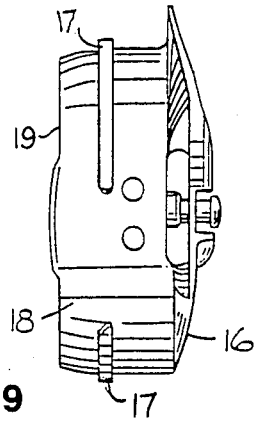
FIG. 8 is a side elevation view of a bobbin basket, around which the rotary loop taker of this invention rotates.
Figure 13:
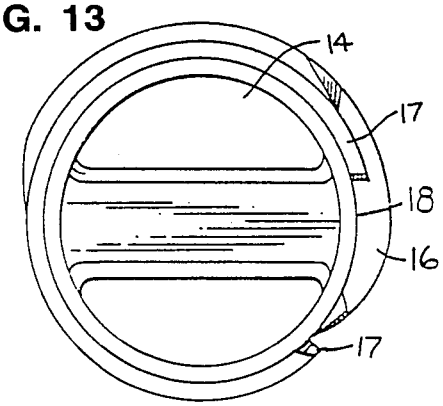
FIG. 13 is a bottom plan view of the bobbin basket around which the rotary loop taker of the present invention rotates.

The bobbin basket 16 is shown in a bottom plan view in FIG. 13 and in a side elevation view in FIG. 8, disassembled from the loop taker 10. It is seen that the bobbin basket 16 has an annular rib 17 on its exterior wall 18 on which the annular frame raceway (not shown in those Figures) 12 travels.

Loop Seizing Point

Figure 2:
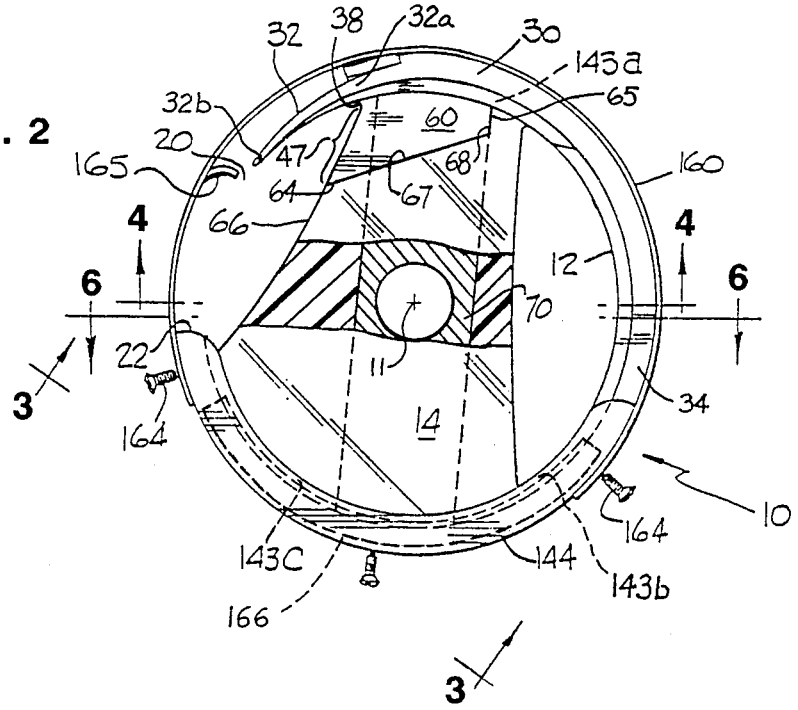
FIG. 2 is a top plan view of the rotary loop taker of FIG. 1, reduced and partly broken away with the addition of a cooling fin on the annular retaining ring thereof.

A portion of substantially annular frame 12 is cut away along one segment of its circumference. Cut-away portion 20 of frame 12 is best seen shown in FIGS. 1, 2 and 5. As there seen, cut-away portion 20 is defined by a rearwardly facing end wall 22 of frame 12 and by the forwardly facing free end and bottom edge of the loop seizing point 30.

Loop seizing point 30 is attached to and has generally the same curvature as substantially annular frame 12. Tapered or reduced forward end 32 extends into cut-away portion 20 of frame 12, and rear portion 34 extends in the other direction along annular frame 12. Tapered forward end 32 includes base portion 32*a* which has the broadest transverse dimensions of forward end 32, tapering to its smallest transverse dimensions at its free end 32*b*.

Loop seizing point 30 is formed from reduced forward end 32 to the rear end of rear portion 34. Tapered forward end 32 is a smoothly shaped element, and loop seizing point 30 has no other projection extending into cut-away portion 20. Rear portion 34 extends rearwardly so that the over-all length of loop seizing point 30 measured from the tip of its forward end 32 to the rear end of rear portion 34 may be a minor portion of the circumference of annular frame 12. In the embodiment shown in FIGS. 1 through 6, the overall length of loop seizing point 30 is approximately one-third of the circumference of frame 12. Loop seizing point 30 may advantageously be only approximately one-quarter of the circumference of frame 12 in length, and in some embodiments it may be somewhat more than a minor portion of the circumference of the frame. The loop seizing point should ordinarily be as long as the raceway upper ledge initial portion so that all that ledge is metal.

In a lock-stitch sewing machine the needle and thread penetrate the material being sewed. When they start to withdraw, the friction between the material and the thread produces a small loop of thread which is hooked by the loop seizing point of the rotary loop taker as the loop taker begins a revolution. The loop of thread is then expanded and passed around the bobbin case as the loop taker rotates, to be pulled off by the take-up device near the end of a full revolution of the loop taker. Cut-away portion 20 of frame 12 provides space for the needle thread to exit from the loop seizing point and to be pulled away from the bobbin case and off the loop seizing point by the take-up device as the rotary loop taker completes its revolution. The successive positions of the needle thread loop as a conventional rotary loop taker revolves are shown in FIGS. 4 through 19 discussed below.

As the loop seizer rotates and the needle reciprocates at 8,000 to 16,000 cycles per minute in very close proximity to one another, the needle invariably collides occasionally with the loop seizing point 30, thereby damaging or breaking either the point or the raceway, or both, thus necessitating replacement of the entire loop seizer.

The rotary loop taker thus far described is fairly conventional in the industrial sewing machine industry As pointed out above, Dickson U.S. Pat. No. 1,431,380 indicates that as long ago as 1921 (when the application for that patent was filed) persons skilled in the art of industrial sewing recognized the inordinate expense of replacing sewing machine loop takers. Haas U.S. Pat. No. 2,219,308 indicates that as long ago as 1939 (when that application was filed) persons skilled in the art attempted a composite loop taker, but for reasons already mentioned above the attempt failed, and no one in the intervening 48 years has devised a workable composite device such as is provided by applicant's invention.

Rotation Of Loop Taker Adjacent Vertically Reciprocating Needle

FIGS. 14 through 19 illustrate how forward end 32 of loop seizing point 30 of rotary loop taker 10 picks up a loop of needle thread as it rotates past needle 100, and carries the loop around until it is released near the end of one full revolution of the loop taker. An understanding of this sequence is helpful to appreciate the novel configuration of the present invention.

In industrial sewing machines of the "drop feed" type, which are ordinarily used for sewing lightweight fabrics or other lightweight materials, the needle moves up and down vertically but is wholly stationary in all horizontal directions. In machines of the "needle feed" type, which are ordinarily used for sewing heavier weight materials, in addition to its vertical movement the needle moves back and forth horizontally a short distance to help move the material along as it is being sewn. The rotary loop taker of this invention may be used with sewing machines of either type, but for illustrative purposes it is shown in FIGS. 14 through 19 in the accompanying drawings as used with a machine of the drop feed type.

Figure 14:
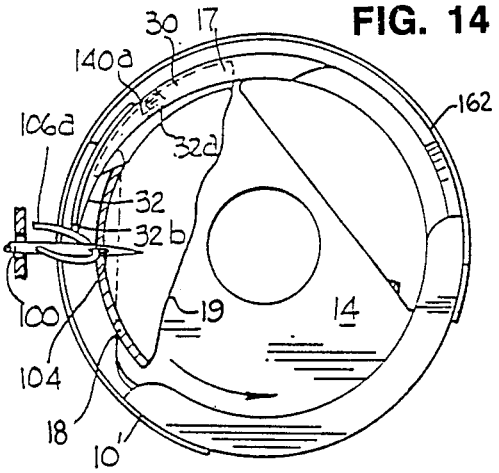
FIG. 14 through 19 are top plan views of the rotary loop taker of the present invention, showing a withdrawing sewing machine needle and the rotary loop taker and the needle thread loop that has been taken up by it, in the approximate successive positions occupied by them as the rotary loop taker goes through one full rotation.

The position of needle 100 as shown in FIG. 14 is just before needle thread loop 106A through 106F is engaged by rotating loop seizing point 30'. The successive positions of needle thread loop 106 are shown in FIGS. 14 through 19 as the loop is picked up by loop seizing point 30' and carried around through nearly one revolution of the rotary loop taker.

Figure 15:
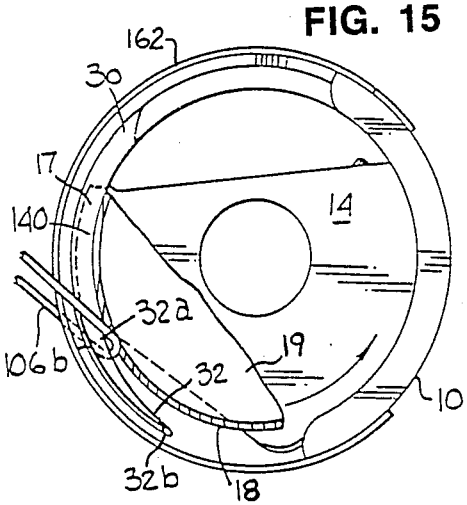
Figure 16:
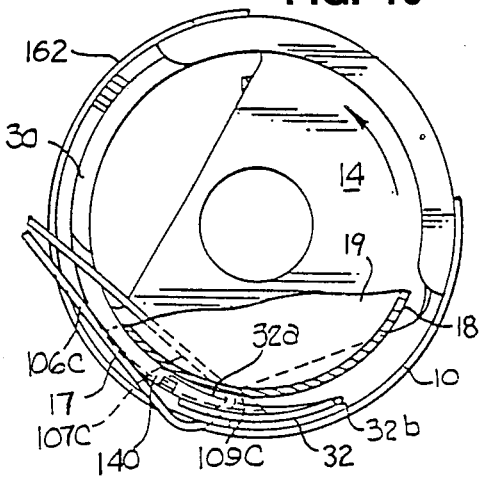

During operation of the sewing machine, needle 100 moves from its closest position toward the shaft shown in FIG. 14, away from the shaft and out of view in FIGS. 15 through 19. When needle 100 moves to the left as it appears in FIG. 14, in the actual sewing machine it is moving vertically upward. In the position shown in FIG. 14, the needle is starting its vertically upward movement, and by the time camming plate 162 has rotated counterclockwise as shown in FIGS. 14–16 into a position where it would strike the needle, the needle has risen above the rotary loop taker and camming plate.

Growth And Contraction Of Needle Thread Loop

The take-up device of the sewing machine, which is located above the bobbin basket (as shown schematically in FIG. 1), plays a part—together with its associated tension assembly—in the production of needle thread loop 106. The thread segment on the thread loop side of the needle 100 passes through the take-up device, and extends from there through the associated tension assembly to the spool of needle thread elsewhere on or near the machine. The other end of the thread extends along the feed dog and above the throat plate of the machine (not shown).

While rotary loop taker 10 is rotating with respect to needle 100 and the needle is reciprocating, as described just above, the take-up device and its associated tension assembly are adjusted to permit needle thread to pay out during the first half revolution of the rotary loop taker in order to permit loop 106 to grow in size as the motion of the rotary loop taker pulls additional thread through needle eye 104, thus producing a needle thread loop 106 of expanding size. Thereafter, during the second half of the revolution of rotary loop taker 10, the take-up device takes up needle thread to cause loop 106 to become smaller until the rotary loop taker reaches a point at which the loop can be pulled off the free end of the loop seizing point.

As seen in FIGS. 14 through 19, loop 106 grows in size from the time it is taken up by rotary loop seizing point until just before rotating loop taker 10 has rotated approximately 240°, and then the loop contracts as the loop taker completes its revolution. In the embodiment shown, as needle 100 moves one cycle during the second revolution of rotary loop taker 10, needle thread loop 106 is pulled up by the take-up device and its associated tension assembly, to tighten the loop around the bobbin thread and secure the resulting lock-stitch against the material being sewed.

Successive Shapes Assumed By Needle Thread Loop

Loop 106*a*, shown in FIG. 14, is the approximate shape of the needle thread loop as the needle begins to withdraw from the loop taker and the loop is picked up by the loop seizing point 30. Ordinarily the needle thread loop remains fairly loose around loop seizing point 30 for this first part of the advance of the rotary loop taker.

When the loop taker has advanced approximately 60° around as shown in FIG. 15, loop 106*b* has been drawn fairly taut against loop seizing point 30, although the take-up device and its associated tension assembly, as discussed above, permit the paying out of needle thread as required during this portion of the rotation of the loop taker. As indicated in FIG. 16, when rotary loop taker 10 has rotated approximately 120° around, thread loop 106*c* is pulled quite taut against the junction between the loop seizing point 30 and the crosswise member 14.

Sliding of Thread In Longitudinal and Transverse Directions Along And Across Tapered Forward End of Loop Seizing Point As the needle thread loop 106 grows in size as just described beginning with FIG. 14, the thread loop slides all the while in the circumferential direction along tapered forward end 32 of loop seizing point 30 from the tip 32*b* of member 32 to base portion 32*a*, and finally (as best seen in FIGS. 1, 2, 5 and 7) to the smoothly curved junction 38 between the forward end of the loop seizing point, annular frame 12 and crosswise support member 14. The thread also slides in the longitudinal direction along its own length. As is seen from FIGS. 14 through 19, needle thread loop 106 in its various configurations is held quite taut (somewhat less so in the last half of the rotation of the loop taker) by the opposing forces of rotating loop seizing point 30 and of the take-up device and its associated tension assembly, which are located above the rotary loop taker. As a result of this continuing tension on the needle thread loop, which holds the loop in taut engagement with the loop seizing point during the first half of one revolution of the loop taker, when the loop grows in size, the thread necessarily slides in the transverse direction across the tapered forward end 32, along the longitudinal axis of the thread, in addition to sliding in the longitudinal direction along the tapered forward end. If it did not do so, the needle thread loop would be broken by the force applied to it by the loop seizing point.

The converse is also true. When the needle thread loop 106*e* and 106*f* is drawn snug against the loop seizing point 30 in the last half of the rotation of the loop taker, and the take-up device and its associated tension assembly pull the needle thread into loops of diminishing size as shown beginning in FIG. 18, the thread 106 must slide along its own length across the loop seizing point 30. If it did not do so, it would not remain snug against the loop seizing point, but would instead flop around loosely and very likely get caught on some protuberance or other in the sewing machine and be broken.

The sliding of the thread in a needle thread loop along its length across the loop seizing point is, of course, movement in the transverse direction with respect to tapered forward end 32 of the loop seizing point 30.

Passing Of Loop Around Bobbin Case

The objective of the forming and circling of the needle thread loop as so far described is to cast a loop of needle thread around the bobbin thread so as to form a lock-stitch as the material is sewed, with the needle thread disposed in the final stitch along one side of the material and the bobbin thread disposed along the other side. This is accomplished by causing needle thread loop 106 to pass around the bobbin basket as it is carried around by rotary loop taker.

Figure 17:
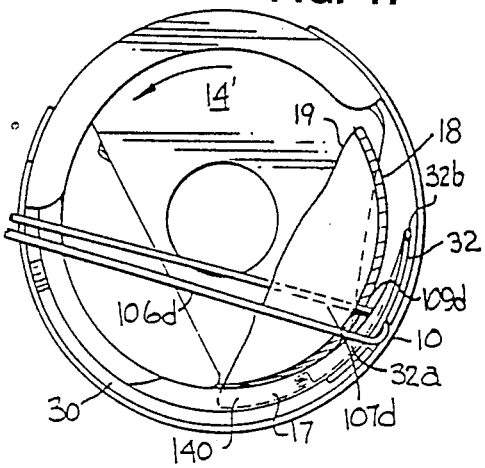
Figure 18:
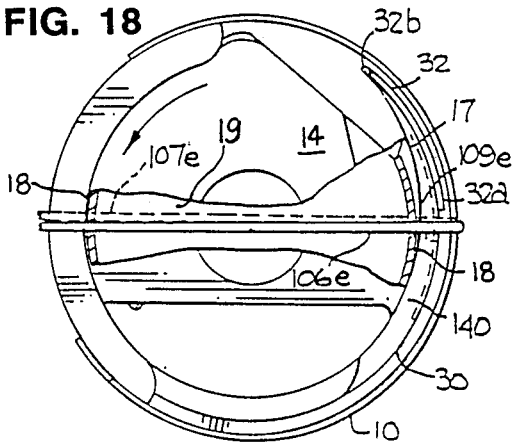
Figure 19:
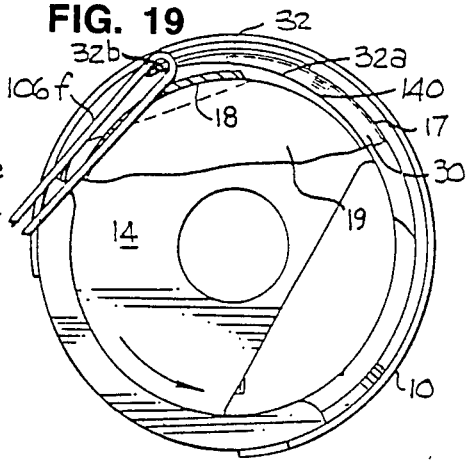

As will be seen from the position of needle thread loops 106*c*, 106*d* and 106*e* in FIGS. 16, 17 and 18, respectively, one segment of the advancing needle thread loop passes over loop seizing point 30 while another segment, indicated at 107*c*, 107*d* and 107*e* passes under the loop seizing point and also under the bobbin basket 16 around which the loop taker rotates. To help illustrate this, FIGS. 14 through 19 contain fragmentary showings of the bobbin case 16, including a portion of bottom wall 19 and outer cylindrical or side wall 18 shown in section.

Fragmentary portions of radially extending rib 17 carried by side wall 18 of the bobbin basket are also shown in FIGS. 14 through 19. Rib 17, which fits snugly into raceway 140 in the inner wall of rotary loop taker 10, maintains the position of the bobbin basket axially of loop taker 10 as the latter rotates about the stationary bobbin basket 16 and past horizontally stationary needle 100. The angular position of the bobbin basket is maintained by a positioning finger (not shown) of a conventional type known to those skilled in the art.

Thus, FIGS. 16 through 18 show how bottom segments 107*c*, 107*d* and 107*e*, respectively, pass under bottom wall 19 of the bobbin basket 16 while the rest of the thread loop 106 passes over the bobbin basket. Specifically, as indicated in FIG. 15, bottom segment 107*c* of loop 106*c* passes at 109*c* around the bottom wall 114 and side wall 18 of the bobbin basket 16, and from there to needle 100. In a similar way, bottom segment 107*d* of loop 106*d* passes under the bobbin basket and at 109*d* upwards towards the needle 100. Needle thread loop 106*e* does the same at 109*e*.

Composition of High Stress Surfaces and Reinforcing Members

The discussion above indicates that the loop seizing point 30 and the junction between the loop seizing point, annular frame 12 and the crosswise member 14, which junction receives the thread loop, expands it and carries it around the bobbin basket 16, must have a strong and smooth surface. That surface is preferably steel with a durometer hardness of 58 to 62 and is formed integrally with the steel reinforcing members of the loop taker 10. The steel surfaces and reinforcing members may be rough castings or forgings machined to the appropriate dimensions, or steel formed by investment castings to the appropriate dimensions. Under either approach, this invention is preferable to prior art devices in that only the exposed metal surfaces need be of exact dimensions and buffed to a polish. As discussed below in connection with the plastic portions of the loop taker, the plastic portions do not require high strength, and will receive the necessary polish in the injection molding process without any additional processing. Next is a description of the configuration and interrelation of the steel members beginning with the loop seizing point 30.

Steel Portion of Loop Seizing Point

Figure 7:
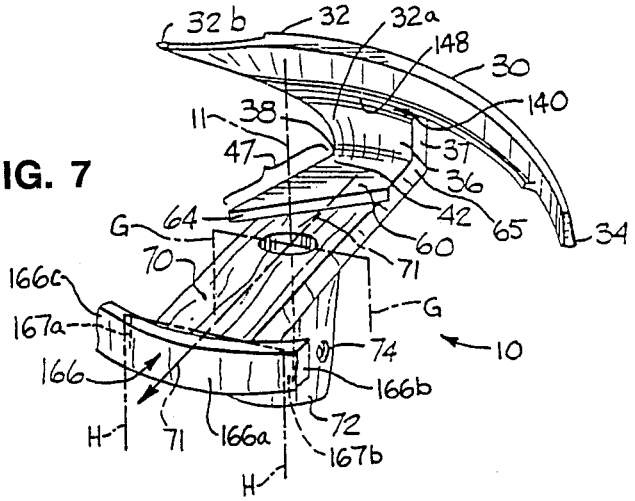
FIG. 7 is a reduced three-quarters perspective, fragmentary view from the top of the embodiment of the rotary loop taker shown in FIG. 1, showing only the metal parts of such loop taker.

FIG. 7 shows the metal portion of the loop taker 10 prior to fabrication of the surrounding plastic portions. The loop seizing point 30 in this embodiment is metal from its free end 32*b* to its rear end 34 and from its upper surface to a plane through the bottom of the upper ledge 148 (see in FIG. 1) of the bobbin basket raceway 140. As is seen from a comparison of FIGS. 1 and 7, forward end 32 of loop seizing point 30, smoothly curved junction 38, the portion of annular frame 12 represented by downwardly extending metal lug 36, lug foot 60, and inwardly extending reinforcing and anchoring means 70 (the last three elements to be described below) are all integrally formed. When the fabrication of the entire rotary loop taker is completed, as for example by an injection molding process as discussed below, the flowable, hardenable material of which the body of the loop taker is formed is in full, intimate contact with lug 36, lug foot 60 and metal reinforcing and anchoring means 70. This configuration of parts provides ample strength and anchoring for the forward tapered portion 32 of the loop seizing point 30 and provides a sturdy metal upper ledge 148 for the bobbin basket raceway 140.

Figure 9:
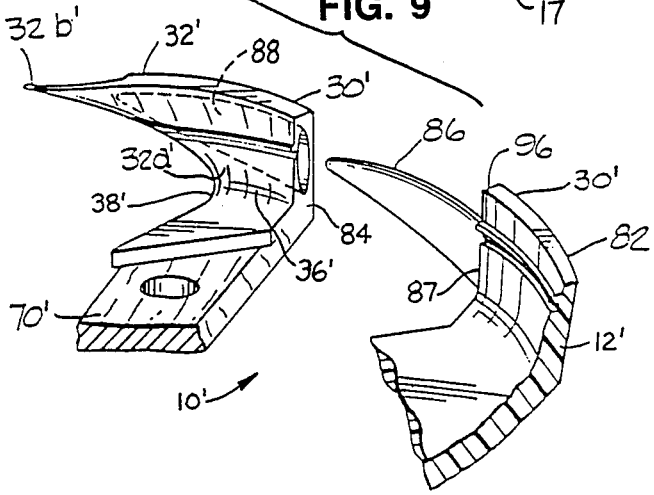
FIG. 9 is an exploded three-quarters perspective, fragmentary view from the top of a second embodiment of the loop seizing point and a portion of the crosswise support member of the rotary loop taker of this invention.

A portion of a second embodiment of the rotary loop taker of this invention is shown in FIG. 9. In this embodiment, the loop seizing point 30' is comprised of a metal forward tapered portion 32' and a plastic rear portion 82 and a boundary 84 between them rearward of the junction 38' with the crosswise member 14. The metal forward tapered portion 32' (formed of exposed metal portions lying at the radially inner and outer surfaces of the tapered portion) and the plastic rear portion 82 are joined by a tapered plastic tongue 86 on the forward edge 87 of the rear portion which mates with a tongue receiving slot 88 positioned in the metal forward tapered portion with full, intimate contact between the plastic and metal members. The tongue 86 and slot 88 arrangement helps improve adhesion of the metal and plastic. FIG. 9 shows a view of the loop taker 10' with the metal tapered forward portion 32' of the loop seizing point 30' separated from the tapered plastic tongue 86. Of course, the plastic portions of the loop taker 10' are normally formed by plastic injection molding around the metal portions. Thus, the plastic portions are not fabricated separately and FIG. 9 is only for illustrative purposes.

The opposed metal portion lying at the inner and outer surfaces of tapered forward portion 32' merge toward its free end 32*b'* so that loop seizing point 30' immediately rearward of its free end 32*b'* is solid metal. As will be seen from FIG. 9, the solid metal portion of tapered forward end 32' extends circumferentially rearward a distance equal to a substantial fraction of the distance from free end 32*b'* to base 32*a'* of tapered forward end 32'. The solid metal preferably extends at least one-fourth to two-thirds of the distance toward the base 32*a'* of the tapered forward portion 32'. As will also be seen from FIG. 9, each of the opposed metal portions lying at the radially inner and outer surfaces of tapered forward end 32' has a substantial thickness relative to the maximum transverse dimension of base 32*a*′ of the tapered forward end.

The metal portion of the tapered forward portion 32′ may also be solid from the free end 32*b*′ continuously to the rearward facing edge 84 that abuts on the edge abutting wall 96 of the annular frame 12′. That arrangement will lend considerable strength to the loop seizing point 30′ and will simplify the manufacture of both the metal portions and plastic portions, but may reduce the adhesion between the metal tapered forward portion 80 and the remainder of the rear portion 82 by reducing the contact surfaces inherent in the tongue and slot arrangement described above.

Alternatively, the metal sheaths or metal surface portions may cover only a portion of the tapered forward end 32′. For purposes of discussion of the metal sheaths or metal surface portions, the exterior surface of tapered forward end 32′ may be divided into four quadrants best seen in FIGS. 1, 4 and 5. Those Figures show an inner lower quadrant 50, an inner upper quadrant 52, an outer lower quadrant 54 and an outer upper quadrant 56. The two upper and two lower quadrants are divided by an imaginary line (not shown) intersecting the tapered forward portion free end 32*b*′ and a point in the middle of the tapered forward portion base 32*a*′. Best results are achieved if the metal sheathing or metal surface portion covers the entire surface of the inner lower quadrant 50 and of the outer lower quadrant 54 because those surfaces receive considerable contact with the thread loop 106 as is evident from FIGS. 14 through 19. Those quadrants must have a strong surface which is also smooth and free of any discontinuities, such as abutments with the plastic portions. For the same reason, metal sheathing or metal surface portions should cover at least a portion of the inner upper quadrant surface 52 and outer upper quadrant surface 56, preferably at least approximately the bottom one-quarter of the outer upper surface 56 and the forward one-half of the inner upper surface 52.

Steel Downwardly Extending Lug

Figure 3:
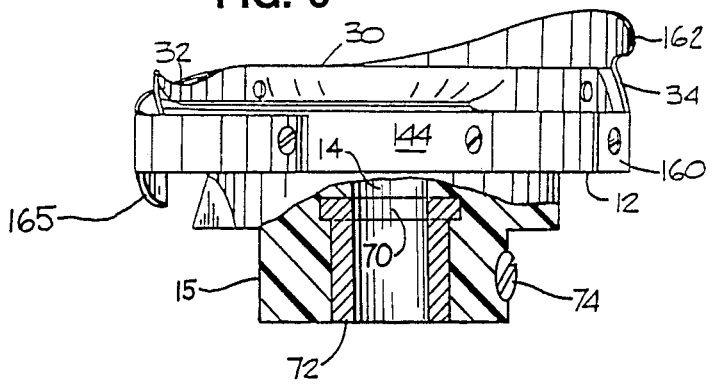
FIG. 3 is a reduced side elevation of the rotary loop taker of FIG. 1, with a sectional view of the loop taker hub.

Referring again to FIG. 7 and also FIGS. 1 through 6, a steel downwardly extending lug 36 connects with and is integral with the loop seizing point 30 and with metal anchoring means 70 (to be described below), which is a part of the crosswise support member 14. As will be seen from the Figures just referred to, lug 36, although formed of a different material from annular frame 12, may be considered as being structurally an extension of, and thus in effect a part of, that substantially annular frame. The circumferentially forward edge of the lug 36 extends downwardly and rearwardly toward the crosswise support member 14 to form (as a structural part of frame 12) a smoothly curved junction 38, free of any seams or joints, with lower quadrants 50 and 54 of tapered forward end 32 and with crosswise support member 14, while the rearward edge extends generally straight downward to the crosswise member 14 perpendicular to the circumference of the annular frame 12. The surface 37 of the rearwardly facing edge abuts a lug-abutting wall 41 (see FIG. 1) of frame 12. Since loop seizing point 30 is attached to frame 12 in a fixed position, this abutting relationship continues at all times. As is shown by FIGS. 1, 4 and 7, this abutting relationship also extends throughout substantially the entire height of supporting lug 36 up to the rearwardly extending rear portion of loop seizing point 30, and throughout substantially the entire forwardly facing surface of frame lug-abutting wall 41 as well. Lug 36 and the surface of lug-abutting wall 41 against which it abuts form at least a close fit at all times, and preferably a snug fit. The abutting surfaces of lug 36 and lug-abutting wall 41 are generally normal, and preferably substantially normal, to the circumference of annular frame 12.

Inwardly Extending Foot On Loop Seizing Point Lug

An important feature of the embodiment of the rotary loop taker of this invention disclosed in FIGS. 1–7 is the provision of a foot 60 extending inwardly toward hub 15 and attached to the lower portion of lug 36, preferably of the same steel as the lug. During operation of the sewing machine, loop seizing point 30 is carried in the direction of the tapered forward portion 32 (counterclockwise in FIG. 1) and takes a loop of thread off the needle (as best seen in connection with loop seizing point 30, in FIGS. 14 through 19). The loop of thread that is taken off the needle in this way slides from the free end 32*b* of the tapered forward portion 32 of loop seizing point 30 (or 30′ in FIGS. 14 through 19) down toward the junction between the lug 36 and crosswise support member 14.

As is seen in FIG. 7 and also in FIGS. 1 and 5 and 14 through 19, lug foot 60 extends inwardly from the lower portion of lug 36 towards the center of annular frame 12 to help provide smoothly curved junction 38 without any seams or joints between lug 36, foot 60, and base portion 32*a* of tapered forward portion 32 that extends forwardly of lug 36. As is evident from the discussion above of FIGS. 14 through 19, this is of great importance in avoiding any possibility of snagging the loop of needle thread that is carried around by the rotating loop taker. As shown in those Figures, smoothly curved junction 38 between lug foot 60 and tapered forward end 32 is preferably gradually curved.

In the preferred embodiment, end wall 64 (shown in FIGS. 1, 2 and 7) of inwardly extending lug foot 60 protrudes from frame 12 and lug 36 a distance 47 at least equal to the diameter of the largest thread with which the sewing machine is used. As a consequence, the loop of thread carried by rotating loop seizing point 30 is not tangled in any way with any aperture or discontinuity on the loop seizing point or its smoothly curved junction 38 with the crosswise support member 14, which avoids the thread snagging and breakage that is discussed above. The loop thread can therefore readily slide off loop seizing point 30 after it has been carried the requisite angular distance by rotation of the point. Thread employed in an industrial sewing machine used with this type loop taker runs typically from about 1/64″ to about 3/64″ in thickness. Thus lug foot 40 may extend inward from lug 36 advantageously at least about 1/64 inch, and improved results are obtained if it extends inward from lug 36 at least about 1/16 inch.

Edge portion 66 (best shown in FIGS. 1 and 2) of crosswise extending support member 14 faces cut-away portion 20 of annular frame 12. The edge portion 66 has a notch in the plastic portion of crosswise member 14 at the leading edge of the end of the crosswise member adjacent the loop seizing point 30. First wall 67 of the notch is generally parallel to the circumference of frame 12, and second wall 68 of the notch is positioned generally radially with respect to annular frame 12. The notch extends inwardly from the inner circumference of frame 12 towards hub reinforcing member 72 to a location inward of the frame. The radially inward wall 64 and circumferentially rearward wall 65 of inwardly extending lug foot 60 abut with the first wall 67 and second wall 68, respectively, of the notch in nesting relationship therewith. Best results are obtained when the first wall 67 and second wall 68 of the notch form a snug fit with inwardly extending lug foot 60 to provide full, intimate contact between the metal lug foot and the plastic material that defines the notch in support member 14.

As is best seen in FIGS. 14 through 19, when the needle loop threads 106 are pulled taut against smoothly curved junction 38 (best seen in FIGS. 1 and 7), they will be able to slide freely across that junction not only laterally but also along their length as further rotation of the rotary loop taker pulls more thread from the needle thread spool located above the throat plate. Those Figures show how smoothly curved junction 38 is embraced by the taut needle thread loop 106 in its sliding movement along the tapered forward end 32 of loop seizing point 30 from the forward end portion **32*b* to base portion 32*a*** and back again. If the loop of needle thread is caught in any crevice or crack along the path followed by the thread as the loop taker rotates, snagging of the thread will break it and will sometimes cause jamming of the machine.

Metal Reinforcing and Anchoring Members

Crosswise member 14 includes interior metal reinforcing and anchoring member 70 (shown in FIGS. 2, 4, 6 and 7) substantially through its length from each side of annular frame 12, encased on all surfaces by the plastic portion of the crosswise support member 14, which serves to anchor the exposed metal surface portions to the loop taker 10. As will be seen, embedding metal reinforcing and anchoring member 70 in the plastic material of crosswise support member 14 produces full, intimate contact between the plurality of exterior contact surfaces on member 70 and the surrounding plastic.

Crosswise reinforcing and anchoring member 70 is thinner than the lug foot 60 to accommodate the plastic encasement of the crosswise member 14, thereby producing a step between the upper surface of the crosswise reinforcing member and the upper surface of the lug foot, while ensuring a smooth abutment between the lug foot and plastic crosswise member. A corresponding step appears between the bottom surfaces of the crosswise reinforcing member 14 and the lug foot 60, also encased in plastic to form a smooth abutment.

As will be seen, reinforcing and anchoring member 70 has a rectangular cross section in plane G—G, with its long dimension oriented transverse to direction 71 in which member 70 extends away from tapered forward end 32. The elongated cross-sectional area of anchoring member 70, as measured transverse to direction 71, helps to achieve the anchoring of loop seizing point 32 in crosswise support member 14. It accomplishes this in two ways. First, the elongation increases the strength of anchoring member 70, in particular in the radial direction and in directions concentric with axis of rotation 11. Second, the elongation increases the area of full, intimate contact between the exterior contact surfaces on member 70 and the surrounding plastic. Both these factors increase the security of the attachment of the loop seizing point to crosswise support member 14, as they cooperate to oppose the various forces that are applied to the loop seizing point as a result of the unavoidable intermittent impact of the tip of the rapidly rotating loop seizing point on the reciprocating needle as the needle moves in and out past the tip.

Figure 6:
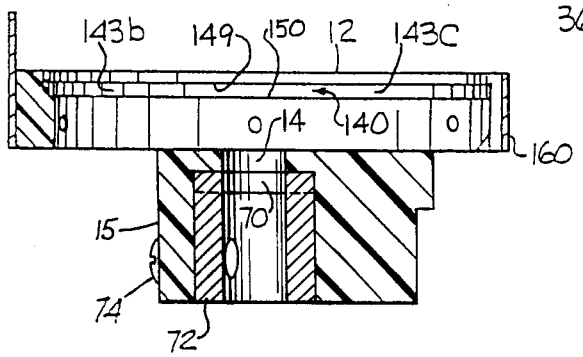
FIG. 6 is a cross-sectional view of the rotary loop taker of FIGS. 1 and 2, taken along the line 6—6 of FIG. 2.

In the embodiment shown, the bottom surface of the metal crosswise reinforcing and anchoring member 70 is attached to the metal hub reinforcing member 72, which is in turn attached to a rotatable shaft (not shown). The hub reinforcing member 72 is normally encased fully in plastic as shown in FIGS. 3, 4 and 6. The applicant has also found that the hub 16 may be entirely plastic, thereby eliminating the need for the hub reinforcing member 72. The hub reinforcing member 72 may be attached to the rotatable shaft by one or more set screws 74 spaced around the circumference of the hub. Alternatively, the attachment may be by the notched pin 73 and hole 75 through the hub 15 and hub reinforcing member 72 which intersects the shaft 76, as depicted in FIG. 20 showing a bottom view of the hub. The notched pin 73 has a tightening screw 77, which tightens against a flattened portion 78 of the hub 16 and urges the notch 79 (to the left in FIG. 20) against the shaft 76. The positioning of the notched pin 73 around the hub 15 circumference can also be used to facilitate balancing of the loop taker 10 about the shaft.

Figure 10A:
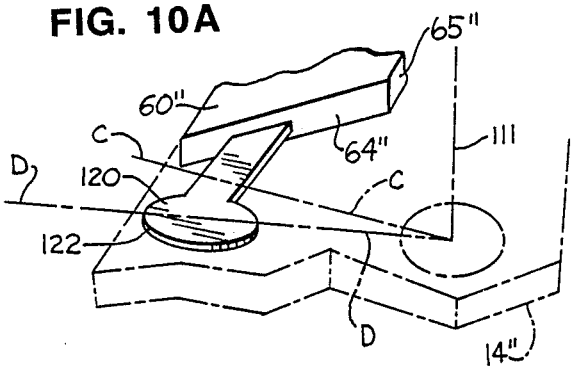
FIG. 10A is a fragmentary showing of the embodiment of FIG. 10.
Figure 10:
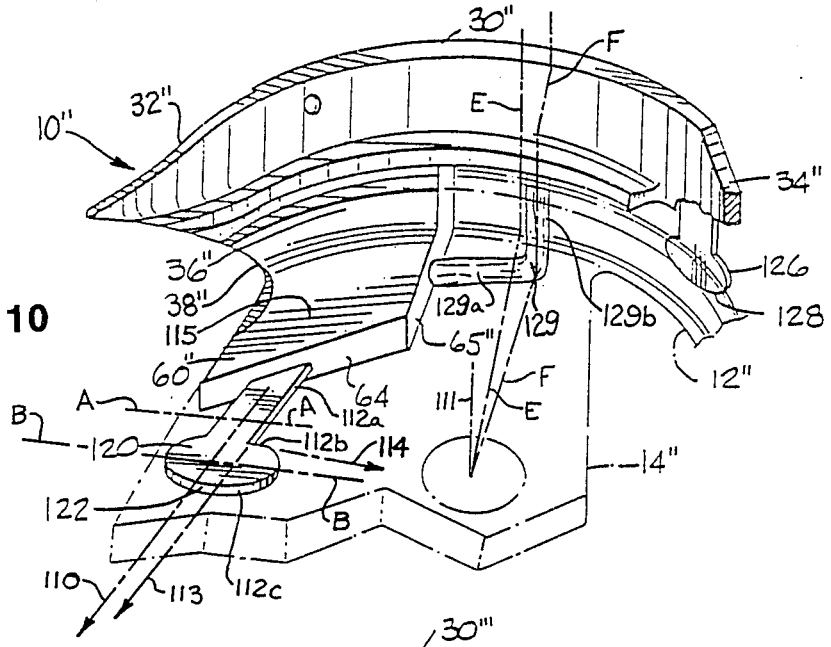
FIG. 10 is a fragmentary three-quarters perspective view from the top of a third embodiment of the present invention, showing the loop seizing point with alternative anchoring means embedded in a plastic crosswise support member.
Figure 11:
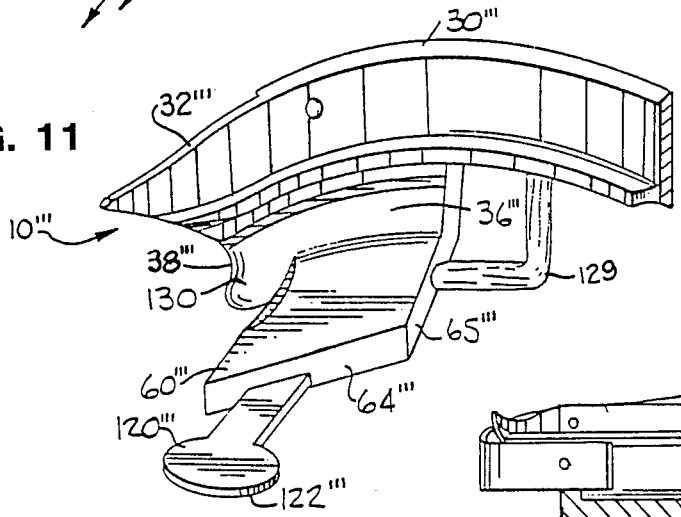
FIG. 11 is a fragmentary three-quarters perspective view from the top of a fourth embodiment of the present invention, showing the loop seizing point with alternative anchoring means embedded in a plastic crosswise support member, also showing a continuation portion of the downwardly extending lug used to prevent a slack thread loop from sliding beneath the lug.

An alternative configuration for anchoring the exposed metal portions to the rest of loop taker 10″ as a part of the third and a fourth embodiment of the rotary loop taker of this invention is shown in FIGS. 10, 10A and 11. Those figures show a flat anchor tab 120 extending from the lug foot end wall 64″ of lug foot 60″ generally toward the opposite side of frame 12″, embedded in the plastic crosswise support member 14″. (The plastic portions of the crosswise member are shown in phantom in FIGS. 10 and 10A). Tab 120 extends away from tapered forward end 32″ of the loop seizing point, as will be seen from FIG. 10, at least a distance substantially equal to the internal radius of annular frame 12″.

The lug foot tab 120 has an enlarged end 122 for improving the attachment with the plastic crosswise member 14″. Another tab 126, shown in FIG. 10, is attached to the loop seizing point 30″ rear portion 34″ and extends downward into the plastic frame 12″, and also has an enlarged end 128 for improving the attachment to the plastic. Finally, an L-shaped anchor 129 of approximately circular cross-section extends rearward from the rear wall 65″ of the lug foot into the plastic crosswise member 14″, and rises through the plastic portion of the frame 12″ to attach to the underside of the loop seizing point 30″ between the end portion 34″ and the attachment of the downwardly extending lug 36″.

With the described arrangement of parts, enlargement of lug foot tab 120 at its free end 122 means that the transverse cross section of inwardly extending metal anchoring means 120 decreases at a given distance from annular frame 30″ and then increases with additional distance from the frame. In a similar way, L-shaped anchor 129 increases in total cross section (measured in a plane that includes the loop taker's axis of rotation 111) at a certain distance circumferentially rearward from tapered forward end 32″ of loop seizing point 30″. It is seen that both of these members help to secure loop seizing point 30″ as a solid and stable component of the rotary loop taker of this invention.

Two other ways of describing the shape of metal anchoring means 120 are as follows. First, as shown in FIG. 10, at a given distance from tapered forward end 32″ of the loop seizing point, another tab 120 has a first predetermined cross-sectional area measured in plane A—A perpendicular to direction 110 in which tab 120 extends from the tapered forward end. Tab 120 has a larger cross-sectional area measured in plane B—B perpendicular to direction 110 at a greater distance from tapered forward end 32''. Second, FIG. 10A shows that tab 120 has a first predetermined cross-sectional area measured in plane C—C that includes axis of rotation 111 of the rotary loop taker. Tab 120 has a larger cross-sectional area measured in a second plane D—D that also includes axis of rotation 111, and is located a greater angular distance about axis 111 from tapered forward end 32'' of the loop seizing point.

Returning to FIG. 10, still another way of describing metal anchoring means 120 is as follows. Anchor tab 120 has a side wall 112 of which a segment **112*a* extends in a first predetermined direction 113 away from tapered forward end 32'' of the loop seizing point. Segment 112*b* of the side wall extends in at least one other direction 114 with respect to tapered forward end 32'', which direction 114 extends away from direction 110 in which tab 120 extends from the tapered forward end, and in this embodiment the side wall extends still farther away from direction 110 along curved segment 112*c*. As will be seen, this configuration of side wall 112 is helpful in anchoring loop seizing point 30''** to the remainder of the rotary loop taker.

As just mentioned, direction 114 extends away from tapered forward end 32''. In this embodiment, both direction 113 and direction 114, as will be seen, lie in a plane perpendicular to loop taker axis of rotation 111.

L-shaped anchor 129 may be described in similar terms. As shown in FIG. 10, anchor 129, integrally formed with the rest of the loop seizing point, extends rearwardly from tapered forward end 32'' in the circumferential direction. It is fully embedded in and fully encased by annular frame 12'', and has a plurality of contact surfaces lying within frame 12'' with which the plastic material of the remainder of the frame lies in full, intimate contact. Segment **129*a* of this rearwardly extending anchor member has a predetermined cross-sectional area measured in first plane E—E that includes axis of rotation 111 of the rotary loop taker. Second segment 129*b* has a larger cross-sectional area measured in second plane F—F that includes axis of rotation 111 and is located at a greater angular distance about that axis from tapered forward end 32''** of the loop seizing point.

As will be seen from this description of lug foot tab 120 and from FIG. 10 of the drawing, member 115 may be considered either a part of lug foot 60'' or a part of the anchoring means that terminates in members 120 and 122. With this in mind, it is seen that at least a portion of the inwardly extending metal anchoring means is fully embedded in and fully encased by crosswise support member 14''. In the embodiment of FIG. 7, inwardly extending metal anchoring means 70 extends in a direction away from tapered forward end 32 of the loop seizing point substantially to the opposite side of the annular frame.

The described configuration of metal anchoring members 120 and 129 helps to produce a secure, permanent attachment of the metal loop seizing point to the remainder of the rotary loop taker. This attachment is further strengthened by the full, intimate contact between the contact surfaces of these two metal anchoring members and the flowable, hardenable material that surrounds them when fabrication of the loop taker is completed, as by an injection molding process as described below.

FIG. 11 also shows a continuation portion 130 below the smoothly curved junction 38''' which may be used in a fourth embodiment of the rotary loop taker of this invention to prevent the thread loop 106 shown in FIGS. 14 through 19 from slipping beneath the lug 36''' as the thread loop becomes slack during the second half of the loop taker 10''' revolution. The continuation portion 130 is integral with the lug 36''' and extends below the lug adjacent to the bottom end of the junction 38''', the forward end 132 of the continuation portion being smoothly curved and convex to provide a surface to receive any slack thread loop 106.

As will be seen, in all cases the metal reinforcing and anchoring member that secures the loop seizing point to the crosswise support member of the rotary loop taker is integrally formed with (1) the solid metal free end of the loop seizing point, (2) the first and second metal surface portions of the tapered forward end of the loop seizing point, and (3) the smoothly curved junction. The anchoring means extends inward toward the central portion of the crosswise support member from the bottom portion of the annular frame for a substantial distance away from the tapered forward end of the loop seizing point, and is embedded in the crosswise support member with a plurality of contact surfaces lying within that member.

Figure 12:
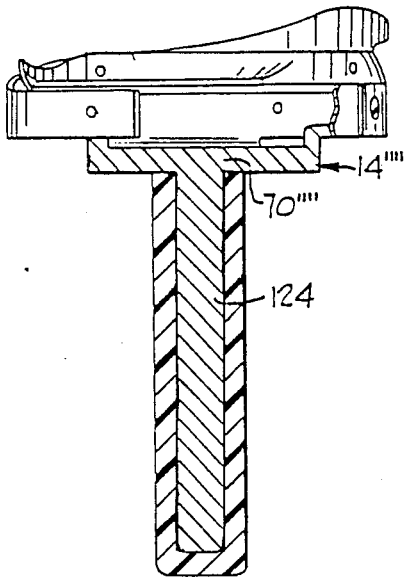
FIG. 12 is a reduced side elevation view of a fifth embodiment of the rotary loop taker of this invention, showing in section view a plastic encased steel shaft integral with the steel crosswise reinforcing member.

FIG. 12 shows a fifth embodiment wherein the reinforcing and anchoring member 70'''' of the crosswise support member 14'''' is attached on its bottom side to a steel shaft 124 which is encased in plastic. The plastic encased shaft 124 may then be mounted in a chuck (not shown) for rotation.

Initial Portion Of Bobbin Case Raceway Defined By Loop Seizing Point

As pointed out above, the bobbin basket with which the rotary loop taker of this invention is used is maintained in a substantially fixed position in the sewing machine. The bobbin basket may be a conventional, generally cylindrical bobbin basket, as discussed above, whose side wall 18 carries rib 17 extending radially from its midsection for guiding the loop taker as the loop taker rotates about the bobbin basket.

The complementary structure in the rotary loop taker of this invention is raceway 140 that extends around inner wall 142 of annular frame 12, best seen in FIGS. 1, 4 and 6, consisting of an initial portion **143*a* beneath the loop seizing point 30, and middle and final portions, 143*b* and 143*c*, respectively, beneath a semicircular bobbin retaining gib 144. The lower ledge 150 of bobbin basket raceway 140 is carried by inner wall 142 of circular frame 12. The upper ledge 148 of the initial portion 143*a* is a shoulder of the loop seizing point 30. Steel semicircular gib 144 secured to the top of frame 12 (FIGS. 1 through 6) defines the upper ledge 149 of the middle and final portions 143*b* and 143*c* of the raceway 140. It is thus seen that the entire upper ledge is preferably of metal. The lower ledge 150 is plastic integral with the plastic annular frame 12 beneath the middle and final portions 143*b* and 143*c* of the raceway 140. Lower ledge 150 beneath most of the initial portion 143*a* of the raceway is also plastic and integral with annular frame 12** except as described in the following paragraphs.

As pointed out above under "Background of the Invention, " one troublesome condition that results from wearing of the bobbin case raceway in the rotary loop taker is known in the industry as "slop." In this condition, the raceway becomes so worn that there is too much play between the outwardly extending bearing rib of the bobbin case and the raceway. As a result, the bobbin case wobbles within the rotary loop taker as the latter rides around it, and this causes interference with the proper release of the needle thread from around the bobbin case. This loose seating of the bobbin case within the rotary loop taker that constitutes the condition of "slop" also increases the incidence of jamming between the bobbin case and the raceway and creates a number of other problems.

An important feature of the rotary loop taker of this invention (best seen in FIGS. 1 and 4) is the provision of a metal leading edge 152 of the lower ledge 150 defining the initial portion 143*a* of bobbin case raceway 140. The metal leading edge 152 is allowed by the novel metal downwardly extending lug 36 and is integral therewith. The leading edge 152 thus tapers away as it meets the tapered forward portion 32 of the loop seizing point 30. As seen from FIGS. 1 and 4, the bottom surface of upper ledge 148 lies in substantially the same plane throughout the entire extent of the ledge. The same is true of lower ledge 150.

Annular Retaining Ring

As earlier explained herein, one of the obstacles to designing an inexpensive plastic rotary loop taker has been expansion of the loop taker in the radial direction caused by centrifugal force at high rotational speeds. As annular frame 12 expands during such high speed rotation, the loop seizing point moves away from the rotational axis, causing destructive collisions between the point and the needle when the tip of the loop seizing point passes by the needle during rotation of the loop seizing point. Moreover, over a period of time the loop taker experiences radial "creep" wherein it fails to contract to its original diameter after the rotation is stopped.

As shown in FIGS. 1 through 6, the preferred embodiment of this invention prevents radial expansion by enclosing the substantially annular frame 12 in a substantially annular retaining ring 160 made of steel or other rigid material completely around the outer wall of the annular frame. A portion of the annular ring 160 may be formed by a steel bobbin retaining gib 144 and the remaining portion by a plate extending around the annular frame exterior wall and attached to each end of the gib, as shown in the Figures.

Whether the ring 160 is one piece or several pieces, it may be an extension of and integral with the camming plate 162 used to raise the thread loop over the bobbin. The annular ring 160 is secured to the annular frame by coarse-threaded screws 164 that extend through the ring (and through the gib 144 if the gib is part of the ring) into the plastic portion of the annular frame 12. Although coarse screws into the plastic portion of the annular ring generally provide sufficient attachment means, additional attachment support can be achieved with the use of fine-threaded screws extending through the thin portion of the ring and the gib and into the steel downwardly extending lug 36 on the loop seizing point 30 side of the annular frame 12 and into the steel supporting wall 166 (see FIG. 7) embedded in the opposite side of the annular frame. The annular ring may also be secured to the annular frame 12 by slidably mounting the ring over a plastic shoulder (not shown) around the frame.

The preferred form of the retaining ring is, as pointed out above, a ring formed of steel or other rigid material that extends completely around the outer wall of the annular frame of the rotary loop taker. However, as will be seen, any retaining ring made of sufficiently rigid material that extends substantially more than halfway around the annular frame will provide opposing ring portions located on radially opposite sides of the frame that will help to avoid the undesirable radial expansion under discussion. It will also be seen that the opposed retaining forces thus applied by a retaining ring will be most effective in helping to avoid destructive collisions between the needle and the loop seizing point if the ring is located in such a position that the effect of these forces is directed against the portion of annular frame 12 that directly supports loop seizing point 30.

The camming plate 162 or annular ring 160 may have a fin 165 attached thereto (shown in FIGS. 1–4 and in FIG. 21 in a flat, developed view) for channeling air into the bobbin basket raceway 140. The fin 165 is preferably smoothly curved from its attachment to the camming plate 162 adjacent to the cut-away portion 20 of the annular frame 12, and extending downward and radially inward into said cut-away portion.

Alternatively, the retaining means may be a cup-shaped member (not shown) substantially covering the bottom surface of the annular frame with sides extending up the outer wall of the annular frame. The bottom of the cup-shaped member provides most of the necessary restraint against radial expansion; therefore, the sides need not enclose the entire loop taker but may be open at the cut-away portion or elsewhere.

Partial Supporting Wall

At the annular wall of the frame 12 opposite the loop seizing point 30, the crosswise support member 14 and the reinforcing and anchoring member 70 therein may be attached to or integral with a partially circumferential supporting wall 166 embedded in the annular frame as shown in FIG. 7. It has been found that an embedded supporting wall 166 extending one-fourth to one-third around the frame 12 circumference and centered about the crosswise reinforcing member 70 lends some additional rigidity to the frame, helps to secure reinforcing and anchoring member 70 to crosswise support member 14, helps prevent radial expansion of the frame caused by centrifugal force during rotation, and can be of the dimensions necessary to balance the loop taker about its axis to reduce wear on the shaft and bearing surfaces. The supporting wall need not have any exposed surfaces and, in fact, will normally be fully encased in plastic to avoid the necessity for close tolerances and careful machining and polishing of the supporting wall surfaces.

In particular, as seen in FIG. 7, wall portion 166*a*, which is defined by planes 167*a* and 167*b*, has a cross-sectional area, measured in plane H—H perpendicular to direction 71 in which crosswise reinforcing and anchoring member 70 extends away from tapered forward end 32, that is larger than the rectangular cross-sectional area of member 70 measured in plane G—G, which is also perpendicular to direction 71. (As will be seen, plane H—H is at a greater distance from tapered forward end 32 than is plane G—G.) This enlargement helps achieve the anchoring of loop seizing point 30 to crosswise support member 14, in the same manner that enlarged end 122 of lug foot tab 120 performs an anchoring function in the embodiments of FIGS. 10 and 11, discussed above.

Wall portion 166b and 166c on either side of wall portion 166a, taken together with wall portion 166a, may extend (as mentioned above) one-fourth to one-third of the distance around the circumference of annular frame 12.

Plastic Frame

The plastic from which the loop taker 10 is substantially made is preferably injection molded around the formed metal portions. Thus, the metal portions are positioned inside the injection mold, the plastic is injected therein, and the complete loop taker is removed.

To improve its strength or wear characteristics, the plastic may have dispersed therein glass fibers, substantially oriented polymer fibers or a solid lubricant, or any combination thereof. For example, the plastic may be Acetal Celcon® or Delrin® which are crystalline thermoplastic polymers with relatively high melting points and dispersions of lubricating TFE fibers, available from Dupont.

The above detailed description has been given for ease of understanding only. No unnecessary limitations should be understood therefrom, as modifications will be obvious to those skilled in the art.

What is claimed is:

1. A rotary loop taker for high speed rotation about a bobbin basket maintained in a substantially fixed position in a lock-stitch sewing machine below the take-up device of said machine, in which sewing machine the needle provides one of the two threads that together form said lock-stitch, said needle thread being taken off the needle in the form of a loop by the loop seizing point of said rotary loop taker as the loop taker rotates about the bobbin basket, the side wall of said bobbin basket carrying a radially extending rib for engaging the loop taker as the latter rotates about said bobbin basket, which rotary loop taker comprises:

(a) a frame of substantially annular construction, said frame having an axis of rotation located generally perpendicular to the frame, the radially inner wall of said frame defining the lower ledge of the middle and final portions of a raceway to receive said radially extending rib on the side wall of said bobbin basket, said frame having a cut-away portion along one segment of its circumference to provide space for the needle thread to exit from the loop seizing point of the rotary loop taker as said thread is pulled off the loop seizing point, said cut-away portion being defined by an end wall of said frame and the forward portion of said loop seizing point facing upon said cut-away portion;

(b) a frame support member extending crosswise of said substantially annular frame, with one edge portion of said support member facing said cut-away portion of the frame;

(c) means for supporting said substantially annular frame for rotation of the same about its said axis of rotation, and about said bobbin basket, during operation of said sewing machine;

(d) a gib secured to said frame to define the upper ledge of said middle and final portions of said bobbin case raceway, (e) a loop seizing point having a tapered forward end including a base and a free end, with the largest transverse dimensions of said tapered forward end being at said base, said base lying immediately adjacent said substantially annular frame, and the smallest transverse dimensions of said tapered forward end being at its said free end, said free end extending circumferentially forward into said cut-away portion of said substantially annular frame; and said tapered forward end of the loop seizing point including on its surface radially inner and outer lower quadrants, and radially inner and outer upper quadrants, each of said quadrants extending from said base to said free end of said tapered forward end, said substantially annular frame forming a smoothly curved junction, free of any seams or joints, with the two lower quadrants of said tapered forward end of the loop seizing point, for guiding said loop of needle thread as it moves from said free end of the tapered forward end down to the rearward-most position assumed by said loop on the portion of said tapered forward end adjacent its base, and back to said free end again, said rotary loop taker being formed of two different materials, one of which is metal of a predetermined type, said free end of said tapered forward end of the loop seizing point being formed of solid metal of said predetermined type, said solid metal free end extending circumferentially rearward a distance at least equal to a substantial fraction of the distance from the free end to the base of said tapered forward end, the radially outer wall of the tapered forward end of the loop seizing point including a first surface portion of metal of said predetermined type extending from said solid metal free end through the above described smoothly curved junction, said metal surface portion forming the entire exterior surface of that part of said radially outer lower quadrant of said tapered forward end that lies circumferentially rearward of said solid metal free end, and forming the exterior surface of at least that part of the approximate bottom one-quarter of said radially outer upper quadrant that lies circumferentially rearward from said solid metal free end, the radially inner wall of said tapered forward end of the loop seizing point including a second surface portion of metal of said predetermined type extending from said solid metal free end through said smoothly curved junction, said metal surface portion forming the entire exterior surface of that part of said radially inner lower quadrant of said tapered forward end that lies circumferentially rearward of said solid metal free end, and forming the exterior surface of at least about the forward one-half of the part of said radially inner upper quadrant that lies circumferentially inward of said solid free end, said first and second metal surface portions each having a substantial thickness relative to the maximum transverse dimension of said base of the tapered forward end of the loop seizing point, said solid metal free end and said first and second metal surface portions being integrally formed with each other and with the above described smoothly curved junction, (f) means formed of metal for anchoring said loop seizing point to said crosswise support member, said metal anchoring means being integrally formed with said solid metal free end and said first and second metal surface portions of said tapered forward end of the loop seizing point and with said smoothly curved junction, said anchoring means extending inward toward the central portion of the crosswise support member from the bottom portion of said annular frame for a substantial distance away from said tapered forward end of the loop seizing point, and being embedded in said crosswise support member, with a plurality of contact surfaces lying within said support member, a substantial part of said rotary loop taker being formed of a second material other than said metal of a predetermined type, said second material comprising a flowable, hardenable material surrounding all said contact surfaces of said metal anchoring means that lie within said crosswise extending support member of the rotary loop taker, in full, intimate contact with said surfaces, and filling all portions of said rotary loop taker not occupied by components thereof that are formed of metal, in full, intimate contact with said metal components, to form a secure, permanent attachment between said metal components and the remainder of the rotary loop taker, the resulting exterior surface of said loop seizing point being smooth throughout its entire area.

2. The rotary loop taker of claim 1 in which said solid metal free end on said tapered forward end of the loop seizing point extends circumferentially rearward from the forwardmost portion of said free end at least a distance approximately equal to ¼ the distance from said forwardmost portion to said base of the loop seizing point.

3. The rotary loop taker of claim 1 in which said first metal surface portion that forms at least a part of the exterior surface of the radially outer upper quadrant of said tapered forward end of the loop seizing point extends throughout the entire area of said quadrant that lies between said solid metal free end and said base of the loop seizing point.

4. The rotary loop taker of claim 1 in which said second metal surface portion that forms at least a part of the exterior surface of the radially inner upper quadrant of said tapered forward end of the loop seizing point extends throughout the entire area of said quadrant that lies between said solid metal free end and the base of the loop seizing point.

5. The rotary loop taker of claim 1 in which said first and second metal surface portions extend throughout the entire exterior surface of said tapered forward end of the loop seizing point that lies between said solid metal free end and said base of the tapered forward end adjacent said substantially annular frame.

6. The rotary loop taker of claim 5 in which the entire tapered forward end of the loop seizing point is formed of solid metal of said predetermined type from its free end to its base adjacent said substantially annular frame.

7. The rotary loop taker of claim 6 in which said substantially annular frame includes a supporting lug integrally formed with said solid metal tapered forward end of the loop seizing point and with said metal anchoring means, which lug extends directly downward from immediately adjacent and circumferentially rearward from said tapered forward end base, the circumferentially forward portion of said lug comprising a portion of said above described smoothly curved junction.

8. The rotary loop taker of claim 6 in which the radially inner wall of said tapered forward end of the metal loop seizing point carries the leading edges of (a) an upper ledge that defines the upper part of the initial portion of said bobbin basket raceway, and (b) a lower ledge that defines the lower part of the initial portion of said bobbin basket raceway, said ledges being integrally formed with said tapered forward end of the metal loop seizing point.

9. The rotary loop taker of claim 7 in which:

(a) said downwardly extending supporting lug includes a foot that extends from the lower portion thereof, from immediately behind said base of said tapered forward end of the loop seizing point, inwardly towards the center of said annular frame to provide a smoothly curved junction between said lug, said foot and said two lower quadrants of said tapered forward end, the surface of said smoothly curved junction being free of any joints or seams and extending radially inward beyond the base of said tapered forward end of the loop seizing point, said lug foot having a rearwardly facing surface and an inwardly facing surface, (b) said crosswise extending support member defines a notch, in its edge portion that faces the cut-away portion of said annular frame, in a position adjacent the radially inner wall of said frame, and (c) said lug foot extends inwardly and rearwardly into said notch in nesting relationship therewith, with said rearwardly and inwardly facing surfaces of said lug foot in intimate contact with the walls of said notch, to form a smooth junction between said notch and said lug foot.

10. The rotary loop taker of claim 7 in which:

said downwardly extending supporting lug has a continuation portion integrally formed therewith of said metal of said predetermined type and extending below and adjacent the bottom end of said smoothly curved junction, said curved junction merging smoothly into said continuation portion, the forward portion of said continuation portion that faces said cut-away portion of the annular frame being located circumferentially forward of said edge portion of the crosswise extending support member that faces said cut-away portion of the annular frame and having a smoothly shaped guide surface for any needle thread loop that falls slack from said loop seizing point and moves downward to the lowest position it occupies during normal operation of the sewing machine, to provide a smoothly shaped barrier to keep any such slack loop that moves downward to said lowest position from passing partly or entirely beneath said supporting lug which extends downward from behind said tapered forward end of the loop seizing point.

11. The rotary loop taker of any of claims 1, 5, 7 or 8 in which said loop seizing point includes a metal portion extending rearwardly from said tapered forward end of the loop seizing point, said rearwardly extending portion being integrally formed with the metal portions of said tapered forward end and with said metal anchoring means, and said rearwardly extending portion having an integral shoulder on its bottom inward edge forming the upper ledge of the initial portion of said raceway.

12. The rotary loop taker of any of claims 1, 5, 7 or 8 in which all parts of the rotary loop taker that are not formed of metal are formed of said second material, which comprises a flowable, hardenable plastic that forms a hard polymeric material having a smooth, slippery exterior surface.

13. The rotary loop taker of claim 12 in which said flowable, hardenable plastic material includes a solid lubricant dispersed therein.

14. The rotary loop taker of claim 12 in which said crosswise frame support member is formed in part of metal.

15. The rotary loop taker of claim 12 which includes a metal arcuate member that together with said gib forms a retaining ring extending substantially around the outer wall of said loop taker on the exterior thereof, to restrain radial expansion of the plastic material included in said substantially annular frame.

16. The rotary loop taker of claim 6 in which said metal anchoring means has at least one side wall that (a) extends in a first predetermined direction away from said tapered forward end of the loop seizing point, then (b) extends in at least one other direction with respect to said tapered forward end, said at least one other direction extending away from said first predetermined direction.

17. The rotary loop taker of claim 16 in which said at least one other direction extends both away from said first predetermined direction and away from said tapered forward end of the loop seizing point.

18. The rotary loop taker of claim 16 in which said first predetermined direction in which said at least one side wall of the metal anchoring means extends and said at least one other direction in which said side wall extends both lie in a plane perpendicular to the axis of rotation of the rotary loop taker.

19. The rotary loop taker of claim 1 in which said metal anchoring means extending away from said tapered forward end of the loop seizing point has (a) a first predetermined cross-sectional area measured, in a first plane perpendicular to the direction in which the anchoring means extends from said tapered forward end, at a given distance from said tapered forward end, and (b) a larger cross-sectional area measured, in a second plane perpendicular to the direction in which the anchoring means extends from said tapered forward end, at a greater distance than said given distance from said tapered forward end.

20. The rotary loop taker of claim 1 in which said metal anchoring means extending away from said tapered forward end of the loop seizing point has (a) a first predetermined cross-sectional area measured in a first plane that includes the axis of rotation of the rotary loop taker, and (b) a larger cross-sectional area measured in a second plane that includes said axis of rotation and is located at a greater angular distance about said axis than said first plane from said tapered forward end of the loop seizing point.

21. The rotary loop taker of claim 1 in which at least a portion of said inwardly extending metal anchoring means is fully embedded in and fully encased by said crosswise support member.

22. The rotary loop taker of claim 1 in which said inwardly extending metal anchoring means extends in a direction away from said tapered forward end to a point adjacent the opposite side of the annular frame.

23. The rotary loop taker of claim 1 which includes a second metal anchoring means integrally formed with said loop seizing point, said second anchoring means extending rearwardly from said tapered forward end of the loop seizing point in the circumferential direction and fully embedded in and fully encased by said substantially annular frame, said rearwardly extending portion having a plurality of contact surfaces lying within said annular frame with which said second, flowable, hardenable material lies in full, intimate contact.

24. The rotary loop taker of claim 23 in which said rearwardly extending metal anchoring means has (a) a predetermined cross-sectional area measured in a first plane, said first plane being located at a given angular distance from said tapered forward end of the loop seizing point and including the axis of rotation of the rotary loop taker, and (b) a larger cross-sectional area measured in a second such plane located at a greater angular distance about said axis of rotation than said given distance from said tapered forward end of the loop seizing point.

25. The rotary loop taker of claim 1 in which said means for supporting said substantially annular frame for rotation about said bobbin basket comprises a hub formed of said metal of a predetermined type, and said inwardly extending metal anchoring means is integrally formed with said hub.

26. The rotary loop taker of claim 5 in which said tapered forward end of the loop seizing point includes a forwardly tapered slot in its interior and a forwardly tapered tongue extending from and integral with said substantially annular frame, with the external walls of said tongue in full, intimate contact with the internal walls that define said slot, said tongue being formed of said flowable, hardenable second material.

27. The rotary loop taker of claim 1 in which said metal anchoring means extends inward toward the central portion of said crosswise support member from said tapered forward end of the loop seizing point for at least a distance substantially equal to the internal radius of said annular frame.

28. The rotary loop taker of claim 1 in which the cross-section of said metal anchoring means, measured transverse to the direction in which the said anchoring means extends away from said tapered forward end of the loop seizing point, is elongated in shape.

29. The rotary loop taker of claim 1 which includes means for balancing the distribution of the weight of the rotary loop taker angularly and radially about its said axis of rotation, said balancing means being positioned generally on the opposite side of said substantially annular frame from said tapered forward end of the loop seizing point.

30. The rotary loop taker of claim 29 in which said balancing means positioned on the opposite side of said substantially annular frame from said loop seizing point is a metal counterweight.

31. The rotary loop taker of claim 30 in which said crosswise frame support member includes a part formed of metal, which metal part and said metal counterweight, said metal anchoring means, said downwardly extending supporting lug, and said solid metal tip are all integrally formed with each other.

32. The rotary loop taker of claim 29 in which said balancing means is comprised of metal and is integrally formed with said metal anchoring means.

33. A rotary loop taker for high speed rotation about a bobbin basket maintained in a substantially fixed position in a lock-stitch sewing machine below the take-up device of said machine, in which sewing machine the needle provides one of the two threads that together form said lock-stitch, said needle thread being taken off the needle in the form of a loop by the loop seizing point of said rotary loop taker as the loop taker rotates about the bobbin basket, the side wall of said bobbin basket carrying a radially extending rib for engaging the loop taker as the latter rotates about said bobbin basket, which rotary loop taker comprises:

(a) a frame of substantially annular construction, said frame having an axis of rotation located generally perpendicular to the frame and having a cut-away portion along one segment of its circumference to provide space for the needle thread to exit from the loop seizing point of the rotary loop taker as said thread is pulled off the loop seizing point, said cut-away portion being defined by an end wall of said frame and the forward portion of said loop seizing point facing upon said cut-away portion, the radially inner wall of said frame defining the lower ledge of the middle and final portions of a raceway to receive said rib that extends radially from the side wall of said bobbin basket;

(b) a frame support member extending crosswise of said substantially annular frame, with one edge portion of said support member facing said cut-away portion of the frame, said edge portion defining a notch adjacent the radially inner wall of said substantially annular frame;

(c) means for supporting said substantially annular frame for rotation of the same about is said axis of rotation, and about said bobbin basket, during operation of said sewing machine;

(d) a gib secured to said frame to define the upper ledge of said middle and final portions of said bobbin basket raceway;

(e) a loop seizing point having a tapered forward end including a base and a free end, with the largest transverse dimensions of said tapered forward end being at said base, said base lying immediately adjacent said substantially annular frame, and the smallest transverse dimensions of said tapered forward end being its said free end, said free end extending circumferentially forward into said cut-away portion of said substantially annular frame, said loop seizing point having generally the same circumferential curvature as said substantially annular frame, said tapered forward end of the loop seizing point being formed entirely of solid metal from its free end to its base adjacent said substantially annular frame and being integrally formed with the hereinafter described smoothly curved junction;

(f) a downwardly extending supporting lug included in said substantially annular frame, said lug being integrally formed with said tapered forward end of the loop seizing point and extending directly downward from immediately behind said tapered forward end base, said downwardly extending supporting lug forming a smoothly curved junction, free of any seams or joints, with said tapered forward end of the loop seizing point, for guiding said loop of needle thread as it moves from said free end of said tapered forward end down to the rearwardmost position assumed by said loop on the portion of said tapered forward end adjacent its base, and back to said free end again, the radially inner walls of said solid metal tapered forward end of the loop seizing point and of said downwardly extending metal supporting lug carrying the leading edge of (i) an upper ledge that defines the upper part of the initial portion of said bobbin case raceway and (ii) a lower ledge that defines the lower part of the initial portion of said bobbin case raceway, said ledges being integrally formed with said tapered forward end of the loop seizing point and said metal supporting lug;

(g) a metal portion extending rearwardly from said tapered forward end of the loop seizing point at the upper portion of said substantially annular frame, said rearwardly extending portion having an integral shoulder on its bottom inward edge forming the initial portion of said upper ledge;

(h) means formed of metal for anchoring said loop seizing point to said crosswise support member, said metal anchoring means being integrally formed with said tapered forward end of the loop seizing point, said downwardly extending supporting lug and said smoothly curved junction, said anchoring means (i) extending inward from the bottom portion of said substantially annular frame and away from said tapered forward end of the loop seizing point at least a distance substantially equal to the internal radius of said frame, and (ii) being embedded in and fully encased by said crosswise extending support member of the rotary loop taker, with a plurality of contact surfaces lying within said crosswise extending support member, said anchoring means having (i) a first predetermined cross-sectional area measured, in a first plane perpendicular to the direction in which the anchoring means extends away from said tapered forward end, at a given distance from said tapered forward end, and (ii) a larger cross-sectional area measured, in a second plane perpendicular to the direction in which the anchoring means extends away from said tapered forward end, at a greater distance than said given distance from said tapered forward end;

(i) means for balancing the distribution of the weight of the rotary loop taker angularly and radially about its said axis of rotation, said balancing means being positioned generally on the opposite side of said substantially annular frame from said tapered forward end of the loop seizing point; and (j) a metal arcuate member that together with said gib forms a retaining ring extending entirely around the outer walls of said rotary loop taker on the exterior thereof, with all portions of said retaining ring being positively connected to each other, to restrain radial expansion of the hereinafter mentioned polymeric material included in said substantially annular frame, said rotary loop taker being formed of two different materials, the first of which is a metal of a predetermined type and the second comprising a flowable, hardenable plastic that forms a hard polymeric material having a smooth, slippery exterior surface, said tapered forward end of the loop seizing point, downwardly extending supporting lug, leading edges of raceway ledges, lug foot, rearwardly extending portion, and anchoring means all being integrally formed of said metal of said predetermined type, and a substantial part of the rotary loop taker being formed of said flowable, hardenable plastic, said flowable, hardenable plastic material surrounding all said exposed contact surfaces of said metal anchoring means that lie within said crosswise extending support member, in full, intimate contact with said surfaces, and filling all portions of said rotary loop taker not occupied by components thereof that are formed of metal, in full, intimate contact with said metal components, to form a secure, permanent attachment between said metal components and the remainder of the rotary loop taker, the resulting exterior surface of said loop seizing point being smooth throughout its entire area.

34. A rotary loop taker for high speed rotation about a bobbin basket maintained in a substantially fixed position in a lock-stitch sewing machine in which the sewing machine needle provides one of the two threads that together form said lock-stitch, said needle thread being taken off the needle in the form of a loop by said rotary loop taker as the rotary loop taker rotates about the bobbin basket, which rotary loop taker comprises:

(a) a substantially annular frame with a cut-away portion along tis circumference;

(b) means for supporting said substantially annular frame for rotation about the bobbin basket during operation of the sewing machine;

(c) a loop seizing point attached to the substantially annular frame with a tapered forward end extending into said cut-away portion for taking said loop off the needle, said tapered forward end having a solid metal free end and a substantially metal surface from said free end to a base end attached to the annular frame;

(d) a substantially annular metal ring attached to the outer wall of said substantially annular frame for retaining the loop taker against radial expansion and creep during rotation about said bobbin basket, a portion of said annular ring being a metal gib attached to the substantially annular frame for retaining said bobbin basket and another portion of said annular ring being a metal arcuate member the inner wall of which conforms approximately to the outer wall of said annular frame, said metal arcuate member having a cam in the axial direction of said frame for facilitating the passing of said loop over the bobbin basket during rotation of the loop taker; and (e) a fin attached to said metal arcuate member and extending circumferentially rearwardly and radially inwardly into said cut-away portion for directing air radially inwardly between said annular frame and said bobbin basket during operation of the sewing machine, said loop taker being substantially of a flowable, hardenable polymeric material.

* * * * *